US008012538B2

(12) United States Patent
Yokouchi

(10) Patent No.: US 8,012,538 B2
(45) Date of Patent: Sep. 6, 2011

(54) METHOD OF MANUFACTURING AT LEAST ONE PROJECTING SECTION OF NOZZLE PLATE, NOZZLE PLATE, INKJET HEAD AND IMAGE FORMING APPARATUS

(75) Inventor: Tsutomu Yokouchi, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 303 days.

(21) Appl. No.: 12/379,846

(22) Filed: Mar. 3, 2009

(65) Prior Publication Data

US 2009/0225133 A1 Sep. 10, 2009

(30) Foreign Application Priority Data

Mar. 4, 2008 (JP) ..... 2008-053534

(51) Int. Cl.
*B05D 5/00* (2006.01)

(52) U.S. Cl. ..... 427/256

(58) Field of Classification Search ..... 427/2.13, 427/466, 510, 514, 256
See application file for complete search history.

(56) References Cited

U.S. PATENT DOCUMENTS 7,273,637 B2 * 9/2007 Morii ..... 427/256
7,459,176 B2 * 12/2008 Sakurada ..... 427/58

FOREIGN PATENT DOCUMENTS

JP 04234665 8/1992

* cited by examiner

*Primary Examiner* — Lamson D Nguyen
(74) *Attorney, Agent, or Firm* — Jean C. Edwards, Esq.; Edwards Neils PLLC

(57) ABSTRACT

A method of manufacturing at least one projecting section of a nozzle plate used in a liquid ejection head, includes: a partial lyophilic rendering step of rendering a lyophilic characteristic to a portion of a lyophobic film provided on an ejection surface side of a substrate in which a nozzle is formed, so as to form a lyophobic portion and a lyophilic portion on the ejection surface side of the substrate; a resin deposition step of depositing a curable resin on the lyophilic portion which has been rendered the lyophilic characteristic; and a curing step of curing the resin deposited on the lyophilic portion in such a manner that the cured resin forms the projecting section.

8 Claims, 14 Drawing Sheets

METHOD OF MANUFACTURING AT LEAST ONE PROJECTING SECTION OF NOZZLE PLATE, NOZZLE PLATE, INKJET HEAD AND IMAGE FORMING APPARATUS

CROSS-REFERENCE TO RELATED APPLICATIONS

This application claims priority under 35 USC §119 from Japanese Patent Application No. 2008-053534, filed Mar. 4, 2008, the disclosure of which is incorporated herein by reference in its entirety.

BACKGROUND OF THE INVENTION

1. Field of the Invention

The present invention relates to a method of manufacturing at least one projecting section of a nozzle plate in a liquid ejection head, and more particularly, to manufacturing technology which is suitable for forming a step section in the vicinity of a nozzle of an inkjet head.

2. Description of the Related Art

A composition for an inkjet head is known in which a step section (a so-called counterbore) is formed on the periphery of the nozzles in order to increase durability in respect of the mechanical breakdown of the liquid repelling film which is formed about the peripheral region of the nozzles, and the nozzles themselves, due to paper jamming, or the like (Japanese Patent Application Publication No. 4-234665). Japanese Patent Application Publication No. 4-234665 proposes that, in order to make the size and the shape of the step section in the nozzle surface easier to manage in terms of production, a step section should be formed on the periphery of the nozzles by bonding a metal plate having holes corresponding to the respective nozzles to a substrate on which nozzles are formed.

However, the structure disclosed in Japanese Patent Application Publication No. 4-234665 has a drawback in that it requires labor in order to form a metal plate having holes which correspond to the nozzles. Furthermore, it is also necessary to accurately position and bond the metal plate to the nozzles formed in the substrate, and therefore the manufacturing process is complicated.

Moreover, if mechanical damage has occurred in the metal plate due to a paper jam, or the like, then it is necessary to replace or repair (restore) the metal plate, but replacement of the metal plate bonded to the surface of the head substrate is extremely complex and hence repair and replacement is not possible in practical terms.

SUMMARY OF THE INVENTION

The present invention has been contrived in view of these circumstances, an object thereof being to provide a method of manufacturing at least one projecting section in a nozzle plate which is easy to manufacture and which can be restored even if damage has occurred due to a paper jam, or the like, and an object being to provide, in combination with this, a nozzle plate obtained by this method of manufacture, and an inkjet head and an image forming apparatus using same.

In order to attain an object described above, one aspect of the present invention is directed to a method of manufacturing at least one projecting section of a nozzle plate used in a liquid ejection head, the method comprising: a partial lyophilic rendering step of rendering a lyophilic characteristic to a portion of a lyophobic film provided on an ejection surface side of a substrate in which a nozzle is formed, so as to form a lyophobic portion and a lyophilic portion on the ejection surface side of the substrate; a resin deposition step of depositing a curable resin on the lyophilic portion which has been rendered the lyophilic characteristic; and a curing step of curing the resin deposited on the lyophilic portion in such a manner that the cured resin forms the projecting section.

In order to attain an object described above, another aspect of the present invention is directed to a nozzle plate comprising a substrate including a nozzle, and at least one projecting section that is made on a periphery of the nozzle by the method of manufacturing at least one projecting section of a nozzle plate.

In order to attain an object described above, another aspect of the present invention is directed to an inkjet head comprising the nozzle plate, and another aspect of the present invention is directed to an image forming apparatus comprising the inkjet head.

According to the present invention, in comparison with a related art method, it is possible to form at least one projecting section (at least one step section) in a simple and inexpensive fashion, so that repair and restoration can be carried out easily in the event of damage to the projecting section.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1A:
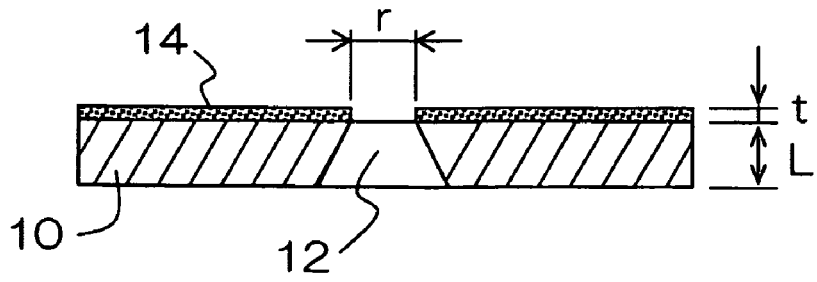
FIGS. 1A to 1D are step diagrams of a method of manufacturing projecting sections of a nozzle plate relating to an embodiment of the present invention.
Figure 1B:
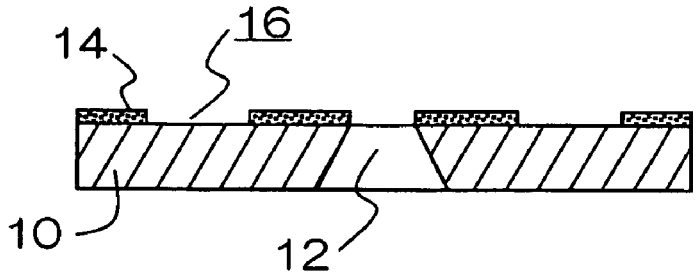
Figure 1C:
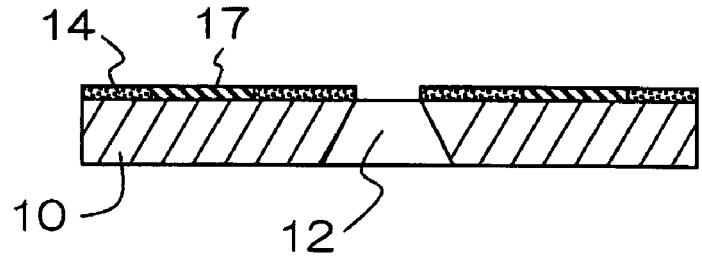
Figure 1D:
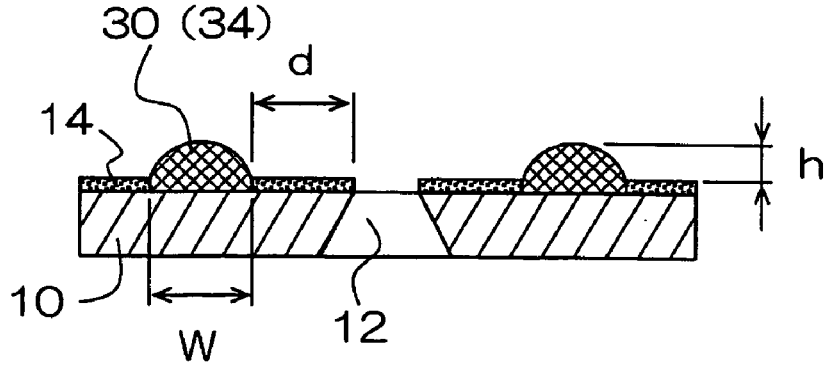
Figure 2A:
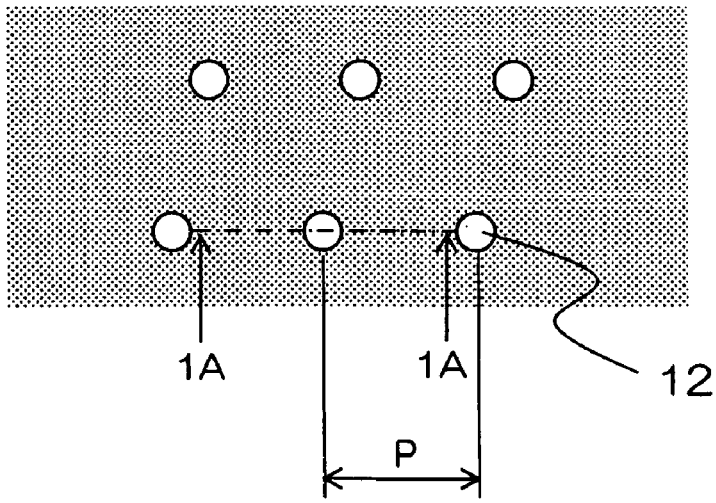
FIGS. 2A to 2C are plan diagrams of FIGS. 1A to 1D.
Figure 2B:
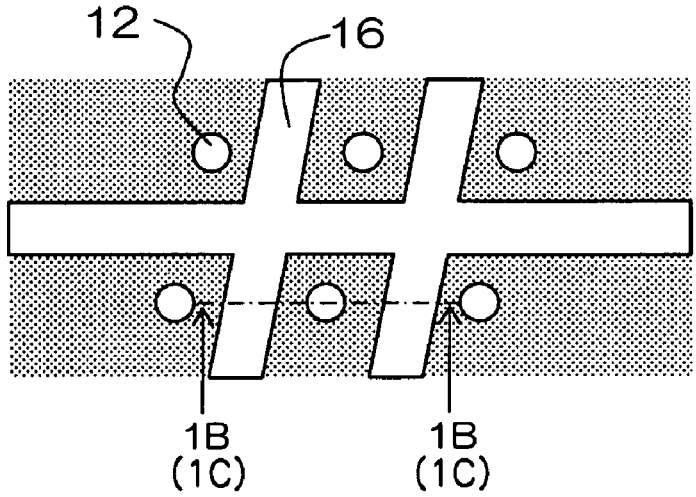
Figure 2C:
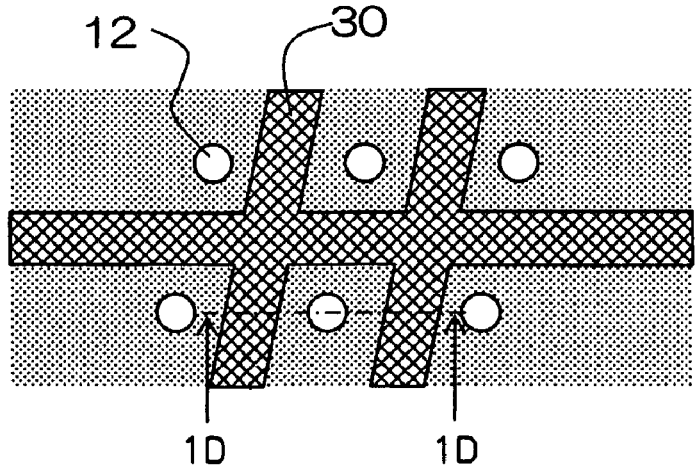

FIGS. 1A to 1D and FIGS. 2A to 2C are illustrative diagrams illustrating a method of manufacturing projecting sections in a nozzle plate relating to a first embodiment of the invention. FIGS. 1A to 1D are cross-sectional diagrams and FIGS. 2A to 2C are plan diagrams illustrating a nozzle plate viewed from the ejection direction. FIG. 1A illustrates a cross-sectional view along line 1A-1A in FIG. 2A, FIGS. 1B and 1C illustrate a cross-sectional view along line 1B-1B (1C-1C) in FIG. 2B, and FIG. 1D illustrates a cross-sectional view along line 1D-1D in FIG. 2C.

In FIGS. 1A to 1D, reference numeral 10 is a nozzle plate (which corresponds to a "substrate") and reference numeral 12 is a nozzle (an aperture forming a liquid ejection port). The upper side in FIGS. 1A to 1D is the ejection surface side, and the liquid passing through a nozzle 12 is ejected from the lower to the upper side in FIGS. 1A to 1D.

Step 1: Step of Forming Nozzles and Lyophobic Film

Firstly, as illustrated in FIG. 1A, a lyophobic film 14 is formed on the ejection side surface of a nozzle plate 10 which comprises nozzles 12. Various methods can be chosen as the concrete method of obtaining the nozzle plate 10 having nozzles 12 and the lyophobic film 14. For example, the nozzles can be formed by etching a silicon substrate, whereupon a lyophobic film 14 is formed by coating (application) or vapor deposition. As a further method, it is also possible to adopt a mode in which a nozzle plate 10 having nozzles 12 is manufactured by electroforming, and a lyophobic film 14 is formed on this plate by coating (application) or eutectic (eutectoid) plating. Since various other methods can also be chosen, the appropriate method should be employed in view of the required accuracy, costs and other factors.

As an example of the specific dimensions of the nozzle plate 10 used in the inkjet recording apparatus, the nozzle diameter r is 10 to 50 μm, the nozzle length L is 10 to 100 μm, the thickness t of the lyophobic film (created by a film deposition method) is several nm to 5 μm, and the nozzle pitch (see FIGS. 2A to 2C) is 40 to 1000 μm.

Step 2: Step of Removing a Portion of the Lyophobic Film at the Periphery of the Nozzles in Order to Improve Wetting Properties in that Portion Next, as illustrated in FIG. 1B, portions of the lyophobic film 14 about the periphery of each nozzle 12 (the portions where the projecting sections are to be formed subsequently) are removed. The removed portions 16 have better wetting properties than the portions where the lyophobic film 14 is still present.

Figure 3:
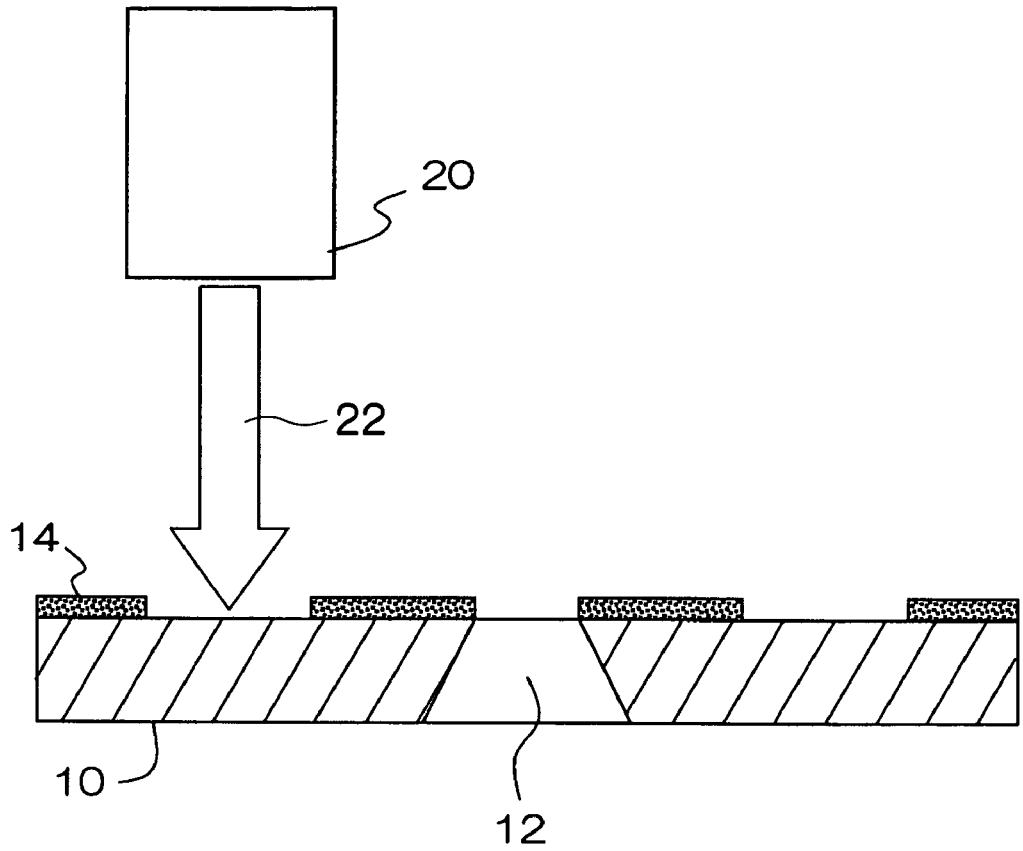
FIG. 3 is an illustrative diagram illustrating a method of removing a lyophobic film by laser.
Figure 4:
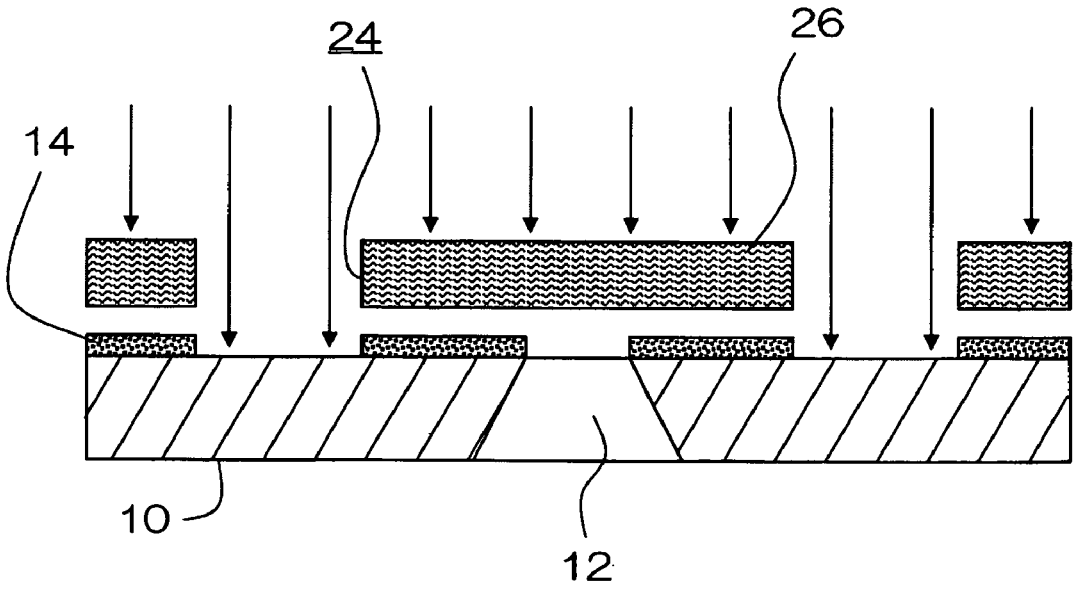
FIG. 4 is an illustrative diagram of a step of removing a lyophobic film by means of ultraviolet light or oxygen plasma.

As a method of removing a portion of the lyophobic film 14, for example, there is a mode in which the film is removed with laser light (see FIG. 3), or a mode where the area other than the portion for removal is masked, and then a portion of the film is removed by plasma processing (using an oxygen plasma, or the like), or by irradiation of ultraviolet light (FIG. 4).

As illustrated in FIG. 3, by irradiating laser light 22 from a laser processing head 20 onto portions of the nozzle plate 10 where the lyophobic film 14 formed thereon is to be removed, it is possible to remove the portions of the lyophobic film 14. For the laser light source, it is possible to select one of various types of the laser light source, such as an excimer laser, a carbon dioxide ($CO_2$) laser, a YAG laser, or the like.

FIG. 4 illustrates an example of a mode of carrying out plasma processing or irradiation of ultraviolet light. As illustrated in FIG. 4, by irradiating an oxygen plasma or ultraviolet light via a mask member 26 which has openings 24 in positions corresponding to portions for removal, portions of the lyophobic film 14 which are exposed via the openings 24 are removed.

If the modes in FIG. 3 and FIG. 4 are compared, then if a portion of the film is removed by laser, a merit is obtained in that no masking member is required. On the other hand, if an oxygen plasma or ultraviolet light is used, then a mask member 26 must be fabricated and aligned with the nozzles 12, but a merit is obtained in that batch processing can be carried out over a surface. The most efficient method should be selected in view of the size of the nozzle plate, the production volume, or other factors.

Furthermore, as a method of improving the wetting properties of one portion (rendering a lyophilic characteristic to one portion) other than a mode which removes a portion of the lyophobic film 14, there is a mode in which the lyophobic film 14 is modified partially (FIG. 1C) or a method where, in locations where it is wished to apply the resin, an intermediate film (not illustrated) that enables the resin to be provided is provided.

Reference numeral 17 in FIG. 1C represents a modified portion of the lyophobic film 14. As a means of selectively modifying a portion of the lyophobic film 14, for example, it is possible to employ oxygen plasma processing using a mask member 26, similarly to FIG. 4.

Step 3: Step of Depositing Resin on Portion where Lyophobic Film has been Removed (Portion which has been Modified so as to Improve Wetting Properties)

Following Step 2 which is described above, resin 30 is deposited onto the removed portions 16 (or the modified portions 17) of the lyophobic film 14, as illustrated in FIG. 1D. Methods of depositing the resin 30 may employ a mode where a resin in liquid form is applied by a dispenser, or a mode where liquid droplets of resin are deposited by being ejected from an inkjet type of ejection head, or the like. It is also possible to apply resin onto a medium such as a sheet, and to then deposit the resin only onto the portions having good wetting properties, by transferring the resin to the nozzle plate 10 by means of the sheet. This method has benefits in that it enables simultaneous batch processing of one surface, but there is a possibility that problems may occur, such as resin being left on the lyophobic film 14, or resin entering inside nozzles 12, and therefore countermeasures have to be taken, such as previously introducing a filler into the nozzles, or the like.

Furthermore, there is also a method in which the nozzle plate is immersed in a resin liquid, but although this method similarly allows simultaneous batch processing of one surface, it also requires measures for introducing a filler into the nozzles, since otherwise the resin will enter into the nozzles.

Apart from this, there is also a method which deposits resin by means of a screen printing technique. This method enables one surface to be processed simultaneously, but it requires a mask in order to apply the resin selectively only to those portions where it is needed.

For the resin 30 which is deposited in Step 3 above, a resin material which can be cured in the subsequent step, Step 4, such as a thermally curable resin or a photo-curable resin, or the like, is used. For example, in the case of an ink ejection head, from the viewpoint of resistance to the ink, or the like, an epoxy type of resin is desirable, and a photo-curable epoxy resin, or a so-called epoxy type of negative resist, can be used. Examples of specific products include: SU-8 made by Kayaku Microchem Co., Ltd. (in particular, the SU-8 3000 series of chemically-amplified negative resists for forming permanent films), a TMMR™ S2000 Permanent Photoresist for MEMS made by Tokyo Ohka Kogyo Co., Ltd., and the like. In terms of ink resistance, polyimide is a possible option, but this requires heat treatment at a high temperature.

Step 4: Step of Curing the Resin

Next, processing is carried out to cure the resin 30 which has been deposited by Step 3 described above. If a photo-curable resin is used, then light which is suited to the curing action of the resin is irradiated, and if a thermally curable resin is used, then heating to a temperature which is suited to the curing action of the resin is carried out. By curing the resin 30, a projecting section 34 is formed on the periphery of a nozzle, and this projecting section 34 forms a step section which protects the nozzle 12.

If a photo-curable resin is used, then heating is not necessary and therefore, for example, even if the nozzle plate has already been assembled in a head, it is possible to carry out curing without giving rise to damage to the head or warping due to the difference between the thermal expansion coefficients of the members.

Consequently, a more desirable mode is one in which a photo-curable resin is used rather than a heat-curable resin.

By forming projecting sections 34 by means of the method of manufacture according to the present embodiment which passes through steps 1 to 4 described above, the action and beneficial effects described below are obtained.

(1) Since the resins 30 are formed in a rounded shape (see FIG. 1D) due to the surface tension of the resins 30 before they are cured, then projecting sections 34 having a rounded shape (which correspond to "projecting sections") are obtained when these resin 30 are cured. Therefore, even if a wiper (blade) abuts against the rounded projecting sections 34 when the ejection surface is wiped, damage is not caused to the wiper and there is little damage to the projecting sections of the resin 30.

In this respect, if the projecting sections are made of metal and are formed to have a shape comprising a corner as described in Japanese Patent Application Publication No. 4-234665, then there is a possibility that the wiper (cleaning blade) might be cut. Furthermore, not only does the wiper receive damage, but there is also a drawback in that the ejection action is adversely affected if cut shards of the wiper enter into the nozzles 12. These technical problems are resolved by the above-described embodiment of the present invention.

(2) If the resin becomes detached due to the paper striking against the projecting sections of resin in the event of a paper jam, or during a wiping action, or the like, then it is possible to repair the resin simply by re-applying the resin and curing it again. This means that the resin can be repaired simply and inexpensively.

The dimensions (width W, height h, and distance d from the nozzle 12) of the projecting sections 34 are decided from experimentation concerning the hardness of the blade during wiping, the wiping conditions, the dimensions such as the nozzle diameter and the nozzle pitch, the damage to the nozzles and the ink removal properties.

An example of the dimensions of a projecting section 34 is illustrated in FIG. 1D. For example, the distance d from the edge of a nozzle 12 to a projecting section 34 is set in the range of 10 to 100 μm, the height h of a projecting section 34 is set in the range of 10 to 50 μm, and the width W of a projecting section 34 is set in the range of 10 to 300 μm, as appropriate.

Second Embodiment

Figure 5:
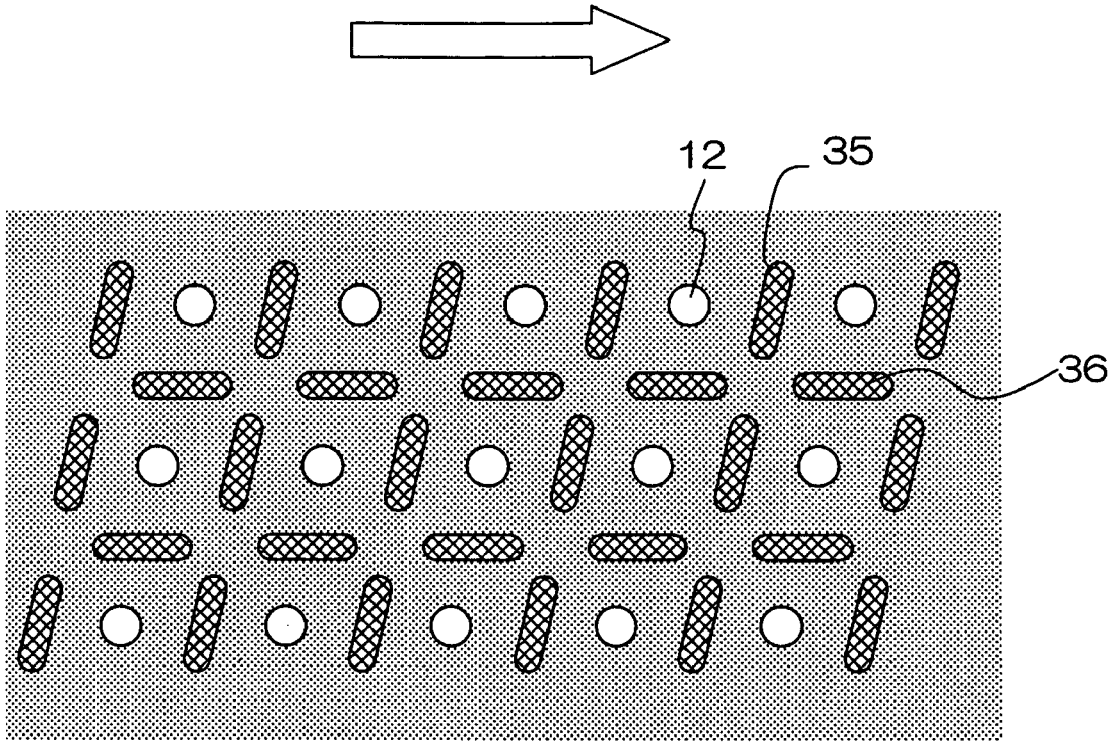
FIG. 5 is a plan diagram illustrating a first example in which projecting sections are formed in a broken line configuration.
Figure 6:
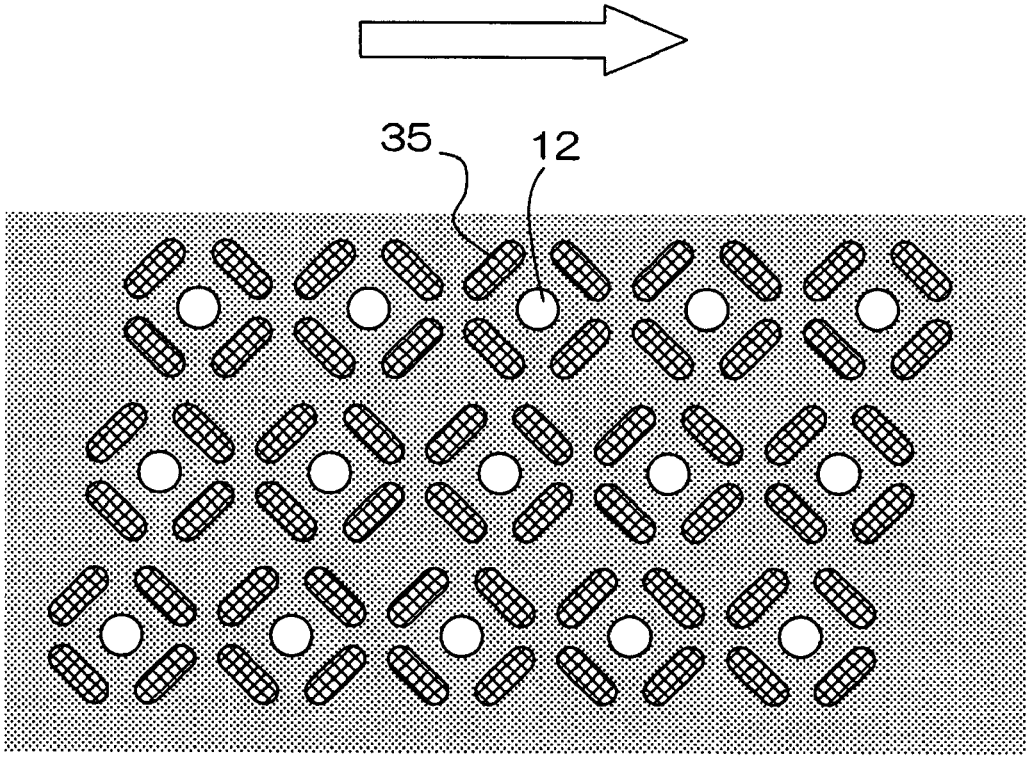
FIG. 6 is a plan diagram illustrating a second example in which projecting sections are formed in a broken line configuration.
Figure 7:
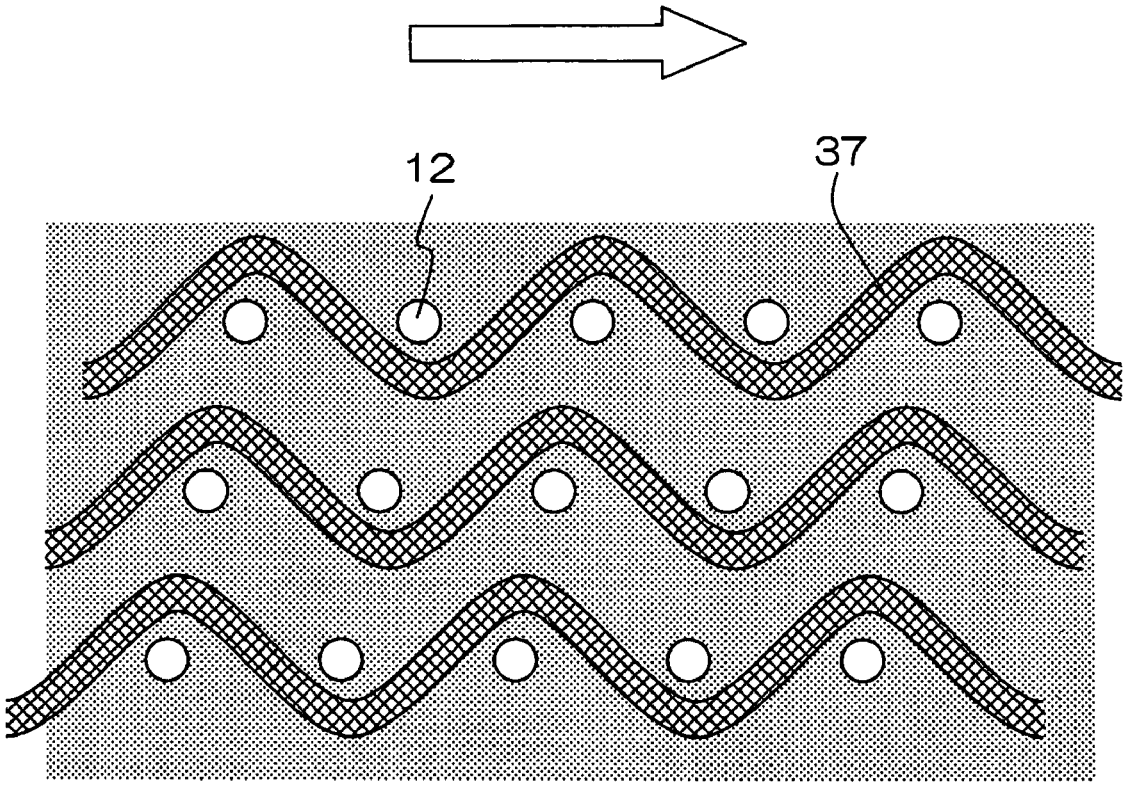
FIG. 7 is a plan diagram illustrating an example in which projecting sections are formed in a curved line shape.

As illustrated in FIGS. 2A to 2C above, the shape of the projecting sections 34 when the nozzle plate 10 is viewed from the direction of ejection may adopt a simple lattice shape whereby the perimeter of respective nozzles 12 is surrounded with a square shape, but from the viewpoint of the ink removal properties, and the wiping properties, it is also desirable to adopt the modes which are illustrated in FIGS. 5 to 7.

The examples in FIG. 5 and FIG. 6 are modes where the projecting sections composed of resin are formed in a dotted (broken line) configuration. According to these modes, when a blade is moved in one direction indicated by the white arrow in the drawings during a wiping action, the surplus ink wiped and collected by the blade is pushed and removed to one side by passing through the break portions (gaps) in the projecting sections 35, and therefore the ink removal properties during wiping are improved.

Furthermore, in the lattice-shaped mode illustrated in FIGS. 2A to 2C, if the resin is made in the form of a line by a dispenser, then the portion where lines of resin 30 are mutually overlapping (intersecting) is recorded twice, and therefore the projecting sections 34 are mounded up to a large height, and damage is more liable to occur to the blade during wiping. Therefore, it is desirable to form the projecting sections 35 and 36 in a broken fashion (island-shaped configuration) as illustrated in FIG. 5 and FIG. 6, for example.

However, if the resin is applied with a dispenser, then a greater amount of labor is required in order to record broken lines, rather than straight lines. On the other hand, if resin is deposited using a mask (by a method such as screen printing), it is not easy to form a mask in continuous straight lines (the strength of the mask declines), and therefore broken lines are desirable.

Furthermore, as illustrated in FIG. 6, it is desirable to form the line segments of the projecting sections 35 at an oblique angle with respect to the wiping direction (indicated by the white arrow in FIG. 6).

If the projecting sections 35 are disposed perpendicularly with respect to the wiping direction, then the ink removal properties are poor and significant damage might be caused by the blade during wiping. Consequently, as illustrated in FIG. 6, by arranging the projecting sections 35 obliquely at a certain angle with respect to the wiping direction, the ink removal properties are improved and the damage during wiping is reduced. The projecting sections 35 illustrated in FIG. 5 are formed at a slight oblique angle with respect to the wiping direction, but since the angle is close to perpendicular, then the mode in FIG. 6 is more desirable from the viewpoint of the ink removal properties and the damage caused by the blade.

The appropriate angle of the projection sections 35 with respect to the wiping direction varies with the material of the blade and the wiping conditions, and so on, but it is between approximately 0 degrees and approximately 60 degrees. In the example in FIG. 6, the angle is approximately 45 degrees.

Third Embodiment

FIG. 7 illustrates a further mode which corresponds to a mode developed from that illustrated in FIG. 6. In the example in FIG. 7, the projecting sections 37 are formed by continuous curved lines which weave in a bending fashion between the nozzles 12 that are aligned in the wiping direction. The curve-shaped projecting sections 37 created by this resin are formed at a suitable oblique angle with respect to the wiping direction which reduces the damage caused by the blade. The example in FIG. 7 illustrates a mode in which an oblique line segment at approximately 45 degrees is bent back in a repeated fashion, and the oblique line segments are connected via bend portions being formed in a circular arc shape.

Fourth Embodiment

In the case of the projecting sections 34 to 37 composed of resin described in FIGS. 1 to 7, the lyophobic properties of the resin itself are inferior to those of the lyophobic film 14, and therefore the liquid wetting properties of the resin are relatively higher. It is also possible to make use of this wettability to improve the liquid removal properties in the vicinity of the nozzles.

Figure 8:
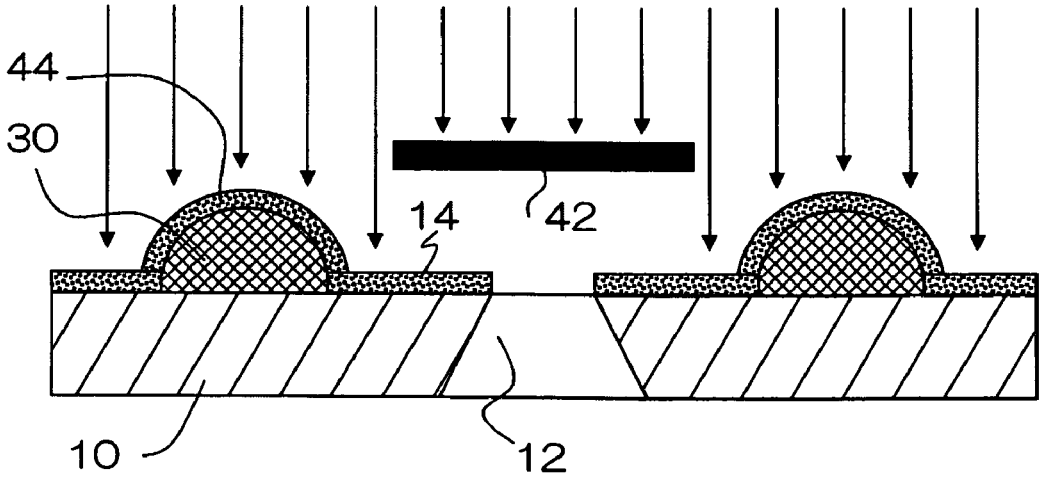
FIG. 8 is an illustrative diagram illustrating an example in which a lyophobic film is also formed on top of the resin.

On the other hand, if the ink removal properties during wiping are a problem (liquid is liable to be left about the periphery of the projecting sections 34 to 37), then as illustrated in FIG. 8, each of the portions corresponding to the nozzles 12 should be concealed with a mask member 42 (for example, a metal mask), and the lyophobic film 44 should be formed by a method such as vapor deposition, for instance. By so doing, a lyophobic film 44 is also formed on each of the projecting sections (34 to 37) of the resin 30, and hence the ink removal properties of the whole nozzle plate are improved.

There may also be a case where, depending on the material of the lyophobic film 44, a further lyophobic film 44 might be formed additionally on the lyophobic film 14 in portions apart from the projecting sections (34 to 37) of the resin 30, but normally, due to the lyophobic properties of the lyophobic film 14, it is difficult to form a further lyophobic film 44 on top of the lyophobic film 14. In this case, a lyophobic film 44 is formed only on the projecting sections (34 to 37) of the resin 30.

Fifth Embodiment

Concerning the method of manufacture described in FIGS. 1A to 1D, it is stated that after forming a lyophobic film 14 uniformly on the ejection surface side of the nozzle plate 10, a portion of that film is removed or modified (FIGS. 1B and 1C), but it is also possible to adopt a mode in which portions where lyophobic film is formed and portions where lyophobic film is not formed are patterned when the lyophobic film 14 is formed, rather than carrying out a staged process as described above. In other words, when forming a lyophobic film, the lyophobic film is deposited in such a manner that the lyophobic film is not present in the portions where the resin is to be deposited in a later stage.

Figure 9A:
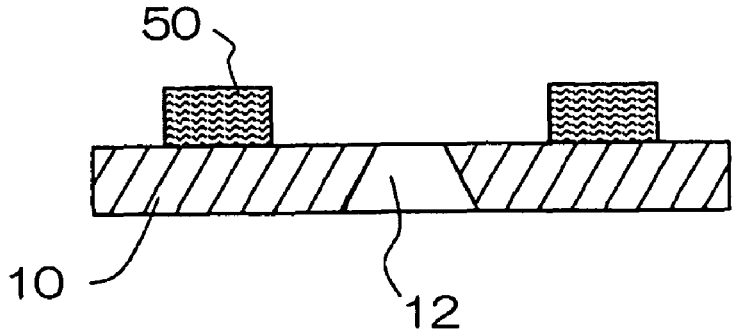
FIGS. 9A to 9C are step diagrams illustrating an example where patterning is carried out during the formation of a lyophobic film.
Figure 9B:
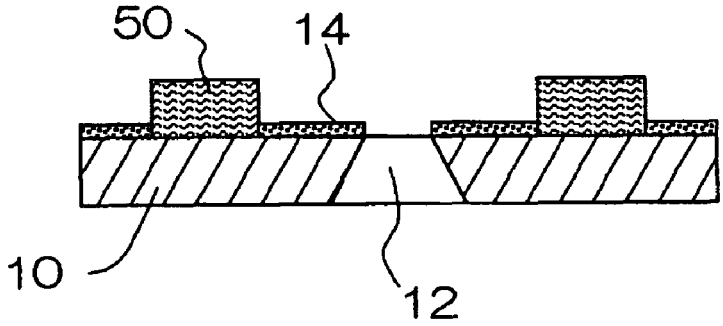
Figure 9C:
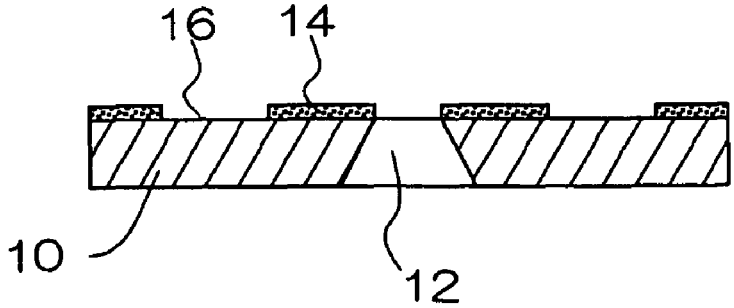

FIGS. 9A to 9C are step diagrams illustrating an example where patterning is carried out during the formation of the lyophobic film.

Firstly, as illustrated in FIG. 9A, a resist (photosensitive resin) 50 is formed on the ejection surface side of a nozzle plate 10 in which nozzles 12 are formed, onto the portions where it is wished to deposit resin 30 in a later step.

Thereupon, a lyophobic film 14 is formed by eutectic plating (eutectoid plating), vapor deposition, or the like (FIG. 9B), and the resist 50 is then removed (FIG. 9C).

According to this method of manufacture, although the step of patterning the resist 50 is added, the step of removing the lyophobic film 14 is eliminated. Furthermore, when the lyophobic film 14 is removed subsequently, if the film is not removed satisfactorily, then there is a possibility that it becomes difficult to deposit resin in the later stage, but according to the method of manufacture described in FIGS. 9A to 9C, it is possible reliably to form a portion where there is no lyophobic film. However, in order to form a lyophobic film 14 on a substrate where resist 50 has been formed (FIG. 9B), it is necessary to match the resist material with the method of forming the lyophobic film, and hence there is a possibility that methods which can be employed to form the lyophobic film can be restricted.

Sixth Embodiment

Furthermore, if the portions on the substrate where the resin is to be deposited are roughened, then the adhesiveness of the resin is improved. The portions where resin is to be deposited can be roughened before depositing resin, and, the whole surface of the substrate (the ejection surface side thereof) can be roughened before forming a lyophobic film 14.

Since it is relatively difficult to carry out processing for roughening the substrate in a partial fashion after forming a lyophobic film, a desirable mode is one where the surface of the substrate is roughened before forming the lyophobic film. If the surface of the substrate is roughened before forming the lyophobic film, then a merit is obtained in that the adhesiveness of the lyophobic film itself is also improved. As the device for roughening the surface of the substrate, it is possible to use blast processing, etching, or the like.

The methods of manufacturing projecting sections of a nozzle plate relating to the respective embodiments described above can be carried out after a nozzle plate 10 formed with nozzles 12 has been assembled in a head. Consequently, it is also possible to select an optimum process until the assembly of the head, and it is easy to repair, restore, replace, etc. the projecting sections after the manufacture of the head. When repairing or restoring the projecting sections, it is also possible to restore damaged portions in a localized fashion, and it is also possible to remove all or a portion of the projecting sections and then reform same.

Of course, methods of manufacturing projecting sections of a nozzle plate according to embodiments of the invention can employ similar steps in respect of the nozzle plate 10 before the assembly thereof in the head, and hence they can be used in a method of manufacturing a nozzle plate.

First Example of Composition of Inkjet Recording Apparatus

Next, an example of an image forming apparatus which uses the inkjet head comprising the nozzle plate described above will be explained.

Figure 10:
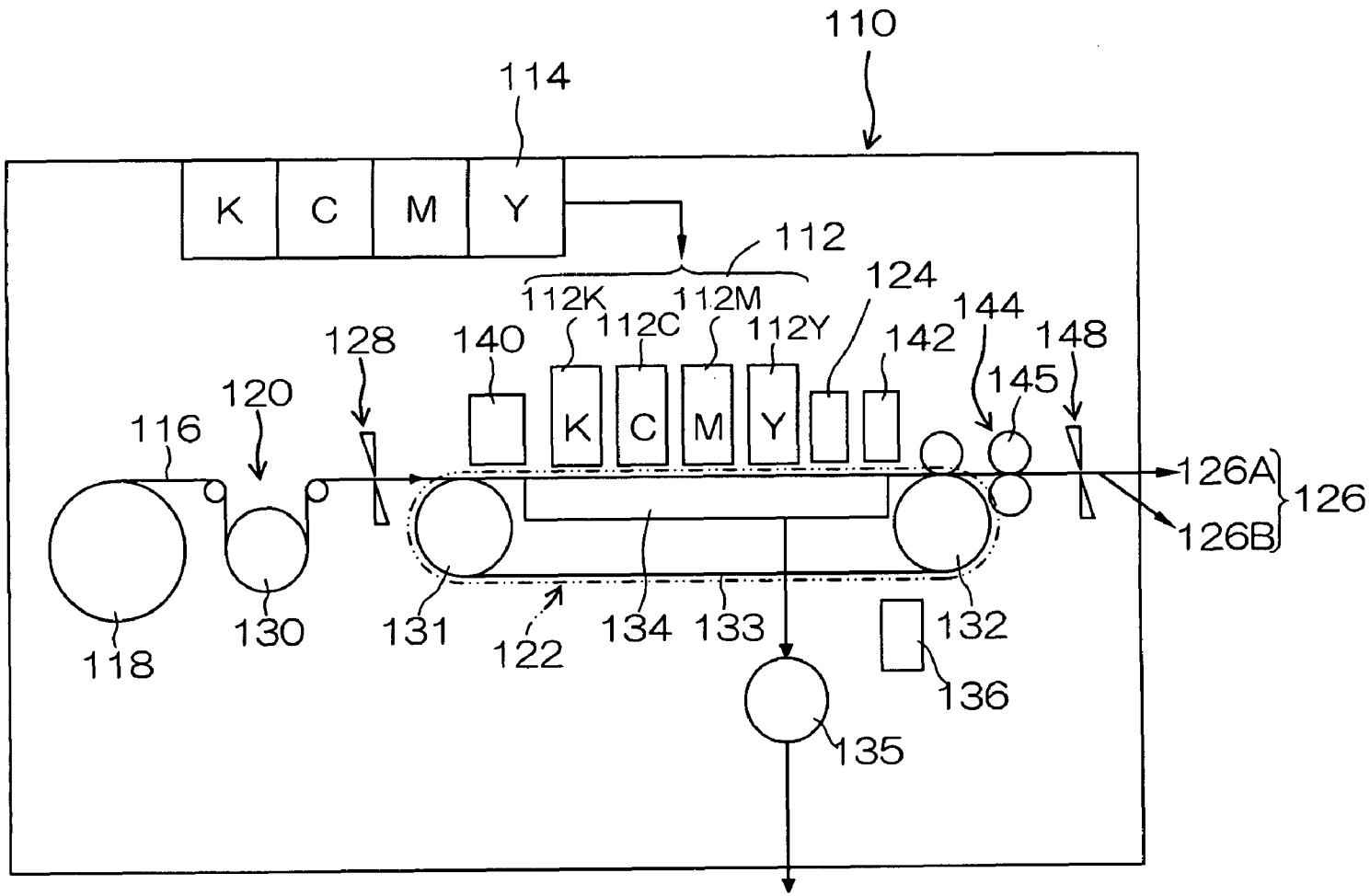
FIG. 10 is a general schematic drawing of an inkjet recording apparatus relating to an embodiment of the present invention.

FIG. 10 is a general configuration diagram of an inkjet recording apparatus including an image forming apparatus according to an embodiment of the present invention. As illustrated in FIG. 10, the inkjet recording apparatus 110 comprises: a print unit 112 having a plurality of inkjet recording heads (hereafter, called "heads") 112K, 112C, 112M, and 112Y provided for ink colors of black (K), cyan (C), magenta (M), and yellow (Y), respectively; an ink storing and loading unit 114 for storing inks to be supplied to the print heads 112K, 112C, 112M, and 112Y; a paper supply unit 118 for supplying recording paper 116 which is a recording medium; a decurling unit 120 removing curl in the recording paper 116; a belt conveyance unit 122 disposed facing the nozzle face (ink-droplet ejection face) of the print unit 112, for conveying the recording paper 116 while keeping the recording paper 116 flat; a print determination unit 124 (corresponding to a determination device) for reading the printed result produced by the print unit 112; and a paper output unit 126 for outputting image-printed recording paper (printed matter) to the exterior.

The ink storing and loading unit 114 has ink tanks for storing the inks corresponding to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 10, a magazine for rolled paper (continuous paper) is illustrated as an example of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (medium) can be used, it is preferable that an information recording medium such as a bar code and a wireless tag containing information about the type of medium is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as illustrated in FIG. 10, and the continuous paper is cut into a desired size by the cutter 128. When cut papers are used, the cutter 128 is not required.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the print unit 112 and the sensor face of the print determination unit 124 forms a horizontal plane (flat plane).

The belt 133 has a width that is greater than the width of the recording paper 116, and a plurality of suction apertures (not illustrated) are formed on the belt surface. A suction chamber 134 is disposed in a position facing the sensor surface of the print determination unit 124 and the nozzle surface of the print unit 112 on the interior side of the belt 133, which is set around the rollers 131 and 132, as illustrated in FIG. 10. The suction chamber 134 provides suction with a fan 135 to generate a negative pressure, and the recording paper 116 is held on the belt 133 by suction. It is also possible to use an electrostatic attraction method, instead of a suction-based attraction method.

The belt 133 is driven in the clockwise direction in FIG. 10 by the motive force of a motor 188 (illustrated in FIG. 16) being transmitted to at least one of the rollers 131 and 132, which the belt 133 is set around, and the recording paper 116 held on the belt 133 is conveyed from left to right in FIG. 10.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not illustrated, examples thereof include a configuration in which the belt 133 is nipped with cleaning rollers such as a brush roller and a water absorbent roller, an air blow configuration in which clean air is blown onto the belt 133, or a combination of these. In the case of the configuration in which the belt 133 is nipped with the cleaning rollers, it is preferable to make the line velocity of the cleaning rollers different from that of the belt 133 to improve the cleaning effect.

The inkjet recording apparatus 110 can comprise a roller nip conveyance mechanism, instead of the belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the print unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

Figure 11A:
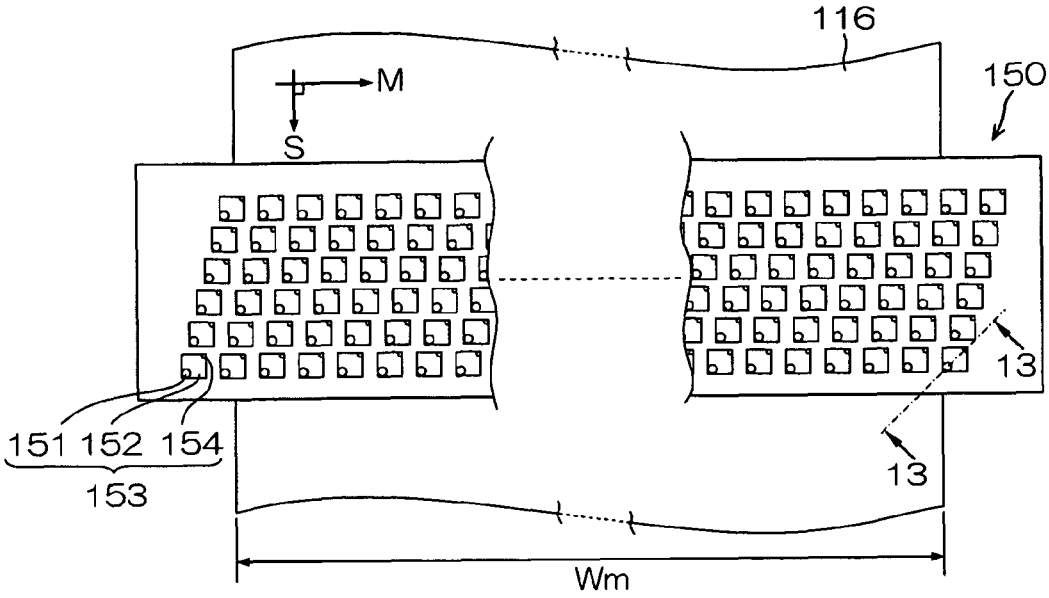
FIGS. 11A and 11B are plan view perspective diagrams illustrating an example of the composition of a print head.
Figure 11B:
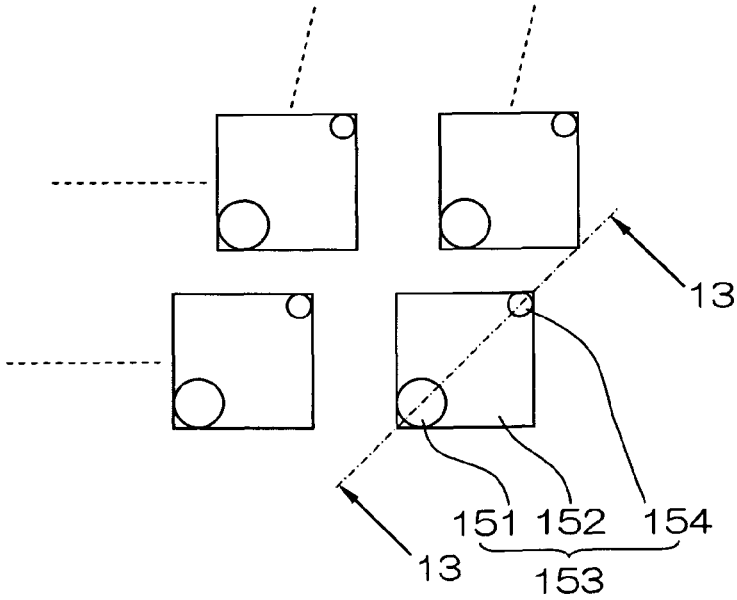

The heads 112K, 112C, 112M and 112Y of the print unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range) (see FIGS. 11A and 11B).

The print heads 112K, 112C, 112M and 112Y are arranged in color order (black (K), cyan (C), magenta (M), yellow (Y)) from the upstream side in the feed direction of the recording paper 116, and these respective heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the print unit 112 in the paper conveyance direction (the sub-scanning direction), in other words, by means of a single sub-scanning action. (This type of recording method is called a single-pass method). Higher-speed printing is thereby made possible and productivity can be improved in comparison with a shuttle (serial) scan type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 124 illustrated in FIG. 10 has an image sensor (line sensor or area sensor) for capturing an image of the droplet ejection result of the print unit 112, and functions as a device to check the ejection characteristics, such as blockages, landing position error, and the like, of the nozzles, on the basis of the image of ejected droplets read in by the image sensor. A test pattern or the target image printed by the print heads 112K, 112C, 112M, and 112Y of the respective colors is read in by the print determination unit 124, and the ejection performed by each head is determined. The ejection determination includes detection of the ejection, measurement of the dot size, and measurement of the dot formation position.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not illustrated) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not illustrated in FIG. 10, the paper output unit 126A for the target prints is provided with a sorter for collecting prints according to print orders.

Structure of Head

Next, the structure of a head will be described. The heads 112K, 112C, 112M and 112Y of the respective ink colors have the same structure, and a reference numeral 150 is hereinafter designated to any of the heads.

Figure 12:
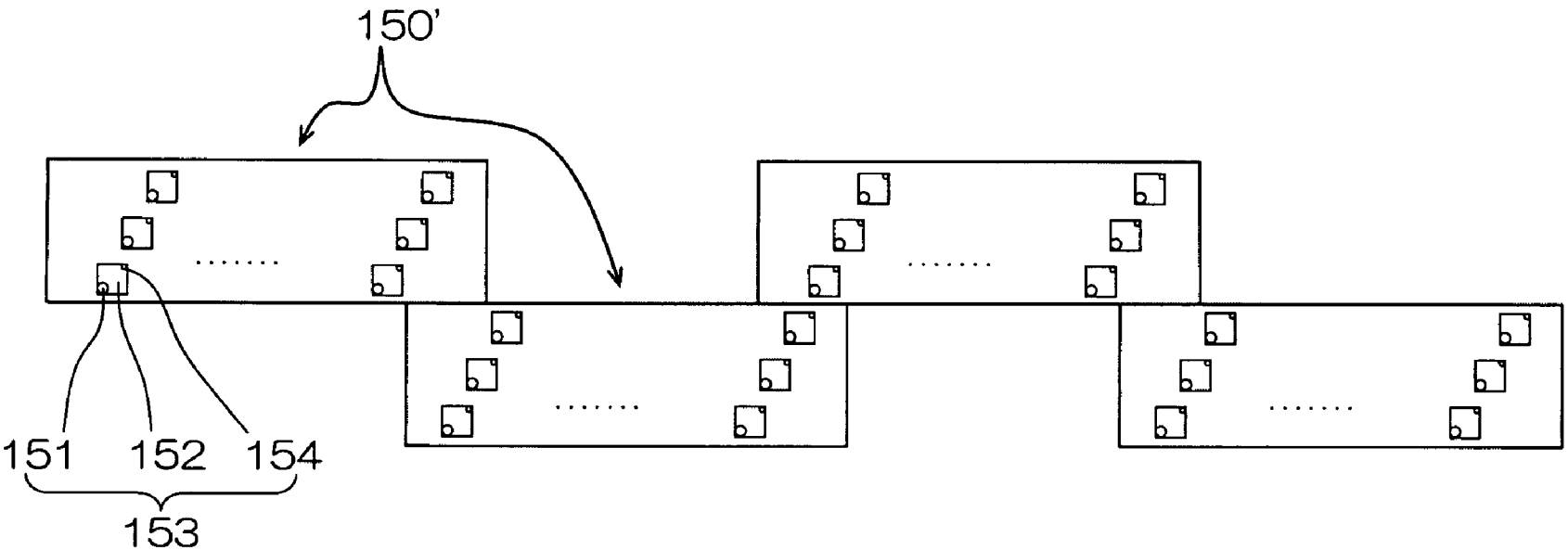
FIG. 12 is a plan view perspective diagram illustrating a further example of the structure of a full line head.
Figure 13:
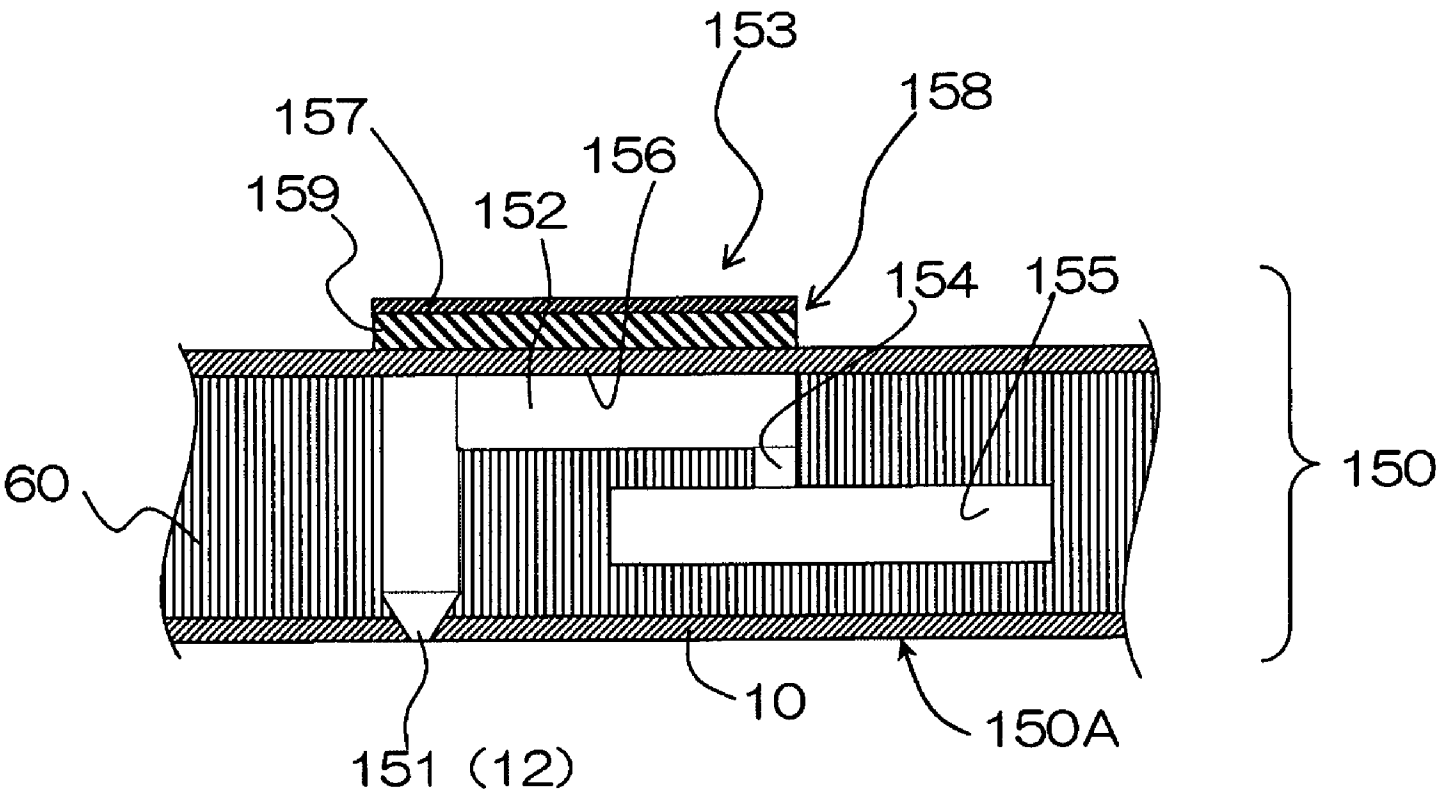
FIG. 13 is a cross-sectional diagram along line 13-13 in FIGS. 11A and 11B.

FIG. 11A is a perspective plan view illustrating an example of the configuration of the head 150, FIG. 11B is an enlarged view of a portion thereof, FIG. 12 is a perspective plan view illustrating another example of the configuration of the head 150, and FIG. 13 is a cross-sectional view taken along line 13-13 in FIGS. 11A and 11B, illustrating the inner structure of a droplet ejection element of one channel constituting a recording element unit (an ink chamber unit for one nozzle 151).

The nozzle pitch in the head 150 should be minimized in order to maximize the density of the dots printed on the surface of the recording paper 116. As illustrated in FIGS. 11A and 11B, the head 150 according to the present embodiment has a structure in which a plurality of ink chamber units (droplet ejection elements) 153, each comprising a nozzle 151 forming an ink ejection port, a pressure chamber 152 corresponding to the nozzle 151, and the like, are disposed two-dimensionally in the form of a staggered matrix, and hence the effective nozzle interval (the projected nozzle pitch) as projected (orthogonal projection) in the lengthwise direction of the head (the direction perpendicular to the paper conveyance direction) is reduced and high nozzle density is achieved.

The mode of forming nozzle rows of a length greater than the length corresponding to the entire width Wm of the recording paper 116 in a direction (the direction indicated by arrow M; the main-scanning direction) substantially perpendicular to the conveyance direction of the recording paper 116 (the direction indicated by arrow S; the sub-scanning direction) is not limited to the example described above. For example, instead of the configuration in FIG. 11A, as illustrated in FIG. 12, a line head having nozzle rows of a length corresponding to the entire width of the recording paper 116 can be formed by arranging and combining, in a staggered matrix, short head modules 150' having a plurality of nozzles 151 arrayed in a two-dimensional fashion.

As illustrated in FIGS. 11A and 11B, the planar shape of the pressure chamber 152 provided for each nozzle 151 is substantially a square, and an outlet to the nozzle 151 is provided in one of corners on a diagonal line of the square, and an inlet of supplied ink (supply port) 154 is provided in the other corner. The shape of the pressure chamber 152 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

As illustrated in FIG. 13, the head 150 is formed by a structure in which a nozzle plate 10, a flow channel plate 60, a diaphragm 156, and the like, are laminated and bonded together.

In the nozzle plate 10 according to the present embodiment, projecting sections (not illustrated in FIG. 13, indicated by reference numeral 34 in FIGS. 1A to 1D, and reference numerals 35 to 37 in FIGS. 5 to 7) and a lyophobic film are formed on the ejection side surface by using a method of manufacture described in the first to sixth embodiments detailed above. This nozzle plate 10 forms the nozzle surface (ink ejection surface) 150A of the head 150, and a plurality of nozzles 151 which are respectively connected to the pressure chambers 152 are formed in a two-dimensional configuration in the nozzle plate 10.

The flow channel plate 60 is a flow channel forming member which constitutes the side wall sections of the pressure chambers 152, and forms a supply port 154 constituting a restrictor section (narrowest section) of the independent supply channel that guides ink from the common flow channel 155 into the pressure chamber 152. For the purpose of the description, FIG. 13 illustrates a simplified depiction, but the flow channel 60 in fact has a structure in which one or a plurality of substrates are laminated together.

As well as forming one side surface of the pressure chambers 152 (the upper surface in FIG. 13), the diaphragm 156 is made of a conductive material such as stainless steel (SUS) or silicon (Si) with a nickel (Ni) conductive layer, or the like, and therefore also serves as a common electrode for the plurality of actuators (here, the piezoelectric elements) 158 which are disposed so as to correspond to the respective pressure chambers 152. A mode is also possible in which a diaphragm is formed by a non-conductive material, such as resin, and in this case, a common electrode layer made of a conductive material, such as metal, is formed on the surface of the diaphragm member.

A piezoelectric body 159 is provided on the surface of the diaphragm 156 on the side opposite to the pressure chambers 152 (the upper side in FIG. 13) at each position corresponding to the pressure chambers 152, and an individual electrode 157 is formed on the upper surface of the piezoelectric body 159 (the surface of the piezoelectric body 159 on the side opposite to the surface in contact with the diaphragm 156 which also serves as a common electrode). A piezoelectric element which functions as an actuator 158 is constituted by the individual electrode 157, the common electrode opposing same (in the present embodiment, this also doubles as the diaphragm 156), and the piezoelectric body 159 which is interposed between these two electrodes. As the material of the piezoelectric body 159, it is desirable to use a piezoelectric material, such as lead titanate zirconate, barium titanate, or the like.

Each pressure chamber 152 is connected to a common channel 155 through the supply port 154. The common channel 155 is connected to an ink tank (not illustrated), which is a base tank that supplies ink, and the ink supplied from the ink tank is delivered through the common flow channel 155 to the pressure chambers 152.

When a drive voltage is applied to the individual electrode 157 of the actuator 158 and the common electrode, the actuator 158 deforms, thereby changing the volume of the pressure chamber 152. This causes a pressure change which results in ink being ejected from the nozzle 151. When the displacement of the actuator 158 returns to its original position after ejecting ink, the pressure chamber 152 is supplied with new ink from the common flow channel 155, via the supply port 154.

Figure 14:
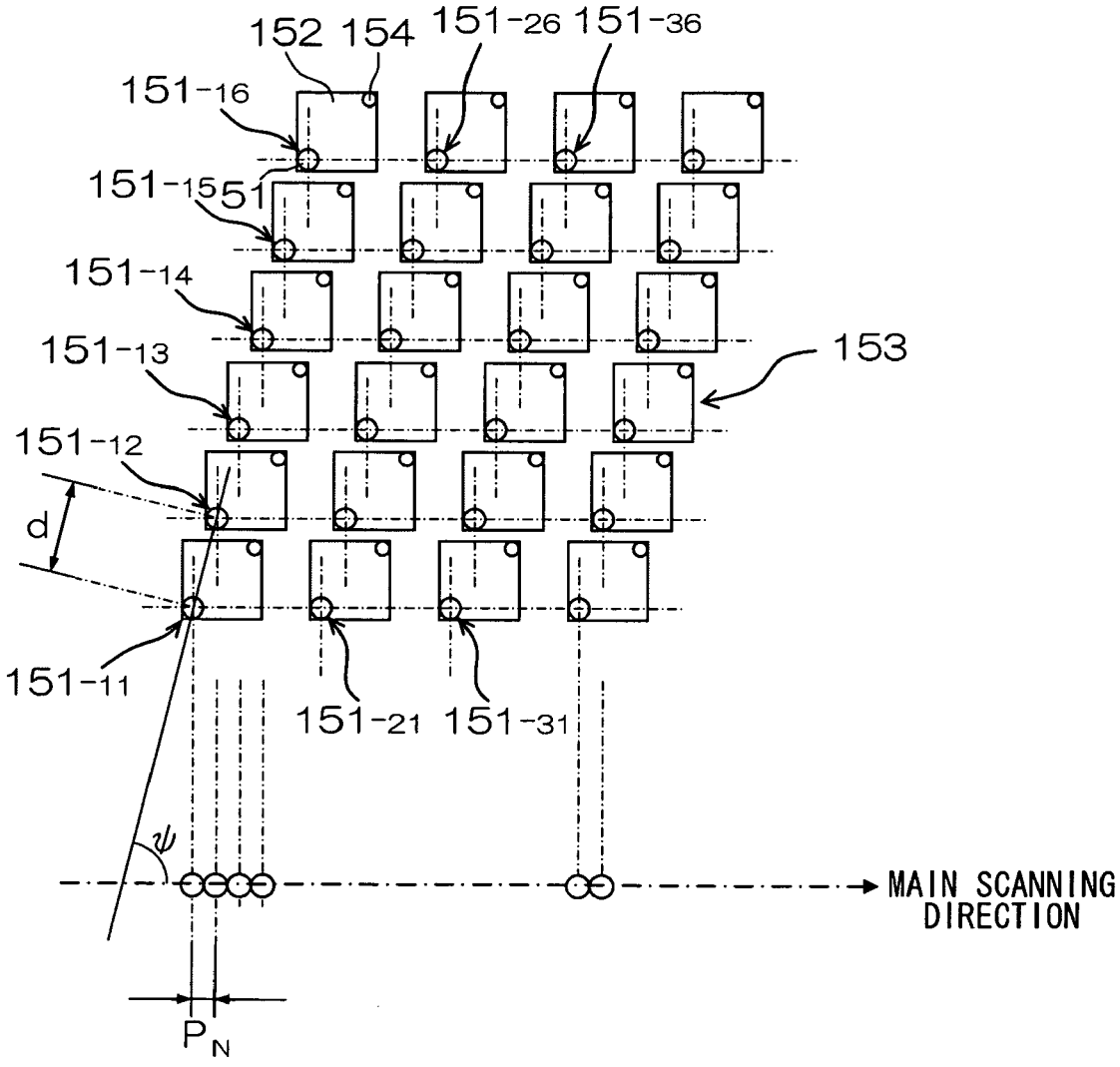
FIG. 14 is an enlarged view illustrating a nozzle arrangement in the print head illustrated in FIGS. 11A and 11B.

As illustrated in FIG. 14, the high-density nozzle head according to the present embodiment is achieved by arranging a plurality of ink chamber units 153 having the above-described structure in a lattice fashion based on a fixed arrangement pattern, in a row direction which coincides with the main scanning direction, and a column direction which is inclined at a fixed angle of ψ with respect to the main scanning direction, rather than being perpendicular to the main scanning direction.

More specifically, by adopting a structure in which a plurality of ink chamber units 153 are arranged at a uniform pitch d in line with a direction forming an angle of ψ with respect to the main scanning direction, the pitch $P_N$ of the nozzles projected so as to align in the main scanning direction is d×COS ψ, and hence the nozzles 151 can be regarded to be substantially equivalent to those arranged linearly at a fixed pitch $P_N$ along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that illustrated in FIG. 14 are driven, the main scanning according to the above-described (3) is preferred. More specifically, the nozzles 151-11, 151-12, 151-13, 151-14, 151-15 and 151-16 are treated as a block (additionally; the nozzles 151-21, 151-22, . . . , 151-26 are treated as another block; the nozzles 151-31, 151-32, . . . , 151-36 are treated as another block; . . . ); and one line is printed in the width direction of the recording paper 116 by sequentially driving the nozzles 151-11, 151-12, . . . , 151-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by the main scanning as described above is called the "main scanning direction", and the direction in which sub-scanning is performed, is called the "sub-scanning direction". In other words, in the present embodiment, the conveyance direction of the recording paper 116 is called the sub-scanning direction and the direction perpendicular to same is called the main scanning direction.

In implementing the present invention, the arrangement of the nozzles is not limited to that of the example illustrated. Moreover, a method is employed in the present embodiment where an ink droplet is ejected by means of the deformation of the actuator, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Configuration of Ink Supply System

Figure 15:
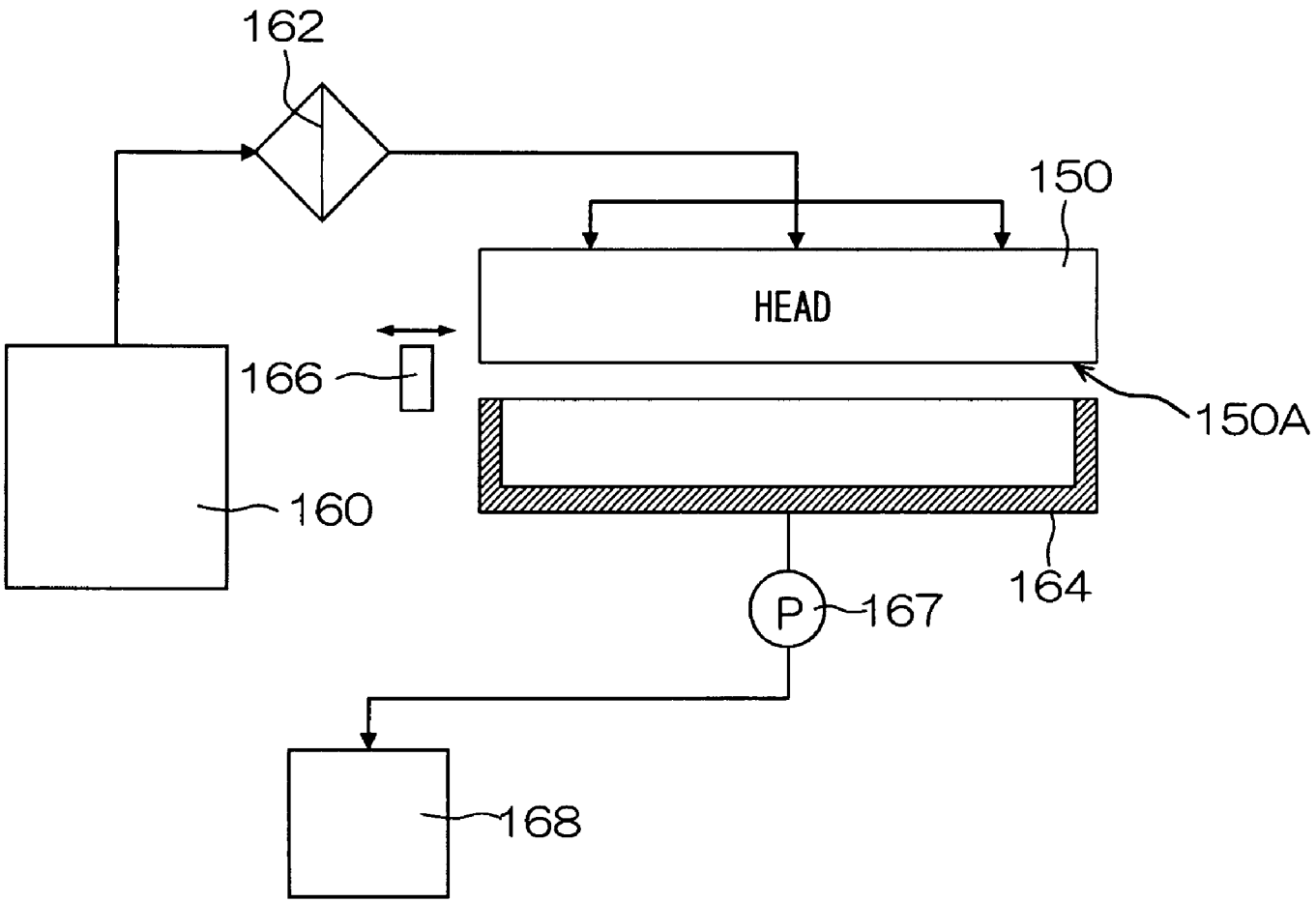
FIG. 15 is a schematic drawing of an ink supply system.

FIG. 15 is a schematic drawing illustrating the configuration of the ink supply system in the inkjet recording apparatus 110. The ink tank 160 is a base tank that supplies ink to the head 150 and is set in the ink storing and loading unit 114 described with reference to FIG. 10. In other words, the ink tank 160 in FIG. 15 is equivalent to the ink storage and loading unit 114 in FIG. 10. The aspects of the ink tank 160 include a refillable type and a cartridge type: when the remaining amount of ink is low, the ink tank 160 of the refillable type is filled with ink through a filling port (not illustrated) and the ink tank 160 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 162 for removing foreign matters and bubbles is disposed between the ink tank 160 and the head 150 as illustrated in FIG. 15. The filter mesh size of the filter 162 is preferably equivalent to or less than the diameter of a nozzle. Although not illustrated in FIG. 15, it is preferable to provide a sub-tank integrally to the print head 150 or nearby the head 150. The sub-tank has a damper function for preventing variation in the internal pressure of the head and a function for improving refilling of the print head.

The inkjet recording apparatus 110 is also provided with a cap 164 as a device to prevent the nozzles 151 from drying out or to prevent an increase in the ink viscosity in the vicinity of the nozzles 151, and a cleaning blade 166 as a device to clean the nozzle face 150A. A maintenance unit (restoration device) including the cap 164 and the cleaning blade 166 can be relatively moved with respect to the head 150 by a movement mechanism (not illustrated), and is moved from a predetermined holding position to a maintenance position below the head 150 as required.

The cap 164 is displaced up and down relatively with respect to the head 150 by an elevator mechanism (not illustrated). When the power of the inkjet recording apparatus 110 is turned OFF or when in a print standby state, the cap 164 is raised to a predetermined elevated position so as to come into close contact with the head 150, and the nozzle face 150A is thereby covered with the cap 164.

The cleaning blade 166 is composed of rubber or another elastic member, and can slide on the nozzle surface 150A (surface of the nozzle plate) of the head 150 by means of a blade movement mechanism (not illustrated). When ink droplets or foreign matter has adhered to the surface of the nozzle plate, the nozzle surface is wiped by sliding the cleaning blade 166 on the nozzle plate.

During printing or standby, when the frequency of use of specific nozzles is reduced and ink viscosity increases in the vicinity of the nozzles, a preliminary discharge (dummy ejection operation) is made to eject the degraded ink toward the cap 164 (which also serves as an ink receptacle).

When a state in which ink is not ejected from the head 150 continues for a certain amount of time or longer, the ink solvent in the vicinity of the nozzles 151 evaporates and ink viscosity increases. In such a state, ink can no longer be ejected from the nozzle 151 even if the actuator 158 for the ejection driving is operated. Before reaching such a state (in a viscosity range that allows ejection by the operation of the actuator 158) the actuator 158 is operated to perform the preliminary discharge to eject the ink whose viscosity has increased in the vicinity of the nozzle toward the ink receptor.

After the nozzle surface is cleaned by a wiper such as the cleaning blade 166 provided as the cleaning device for the nozzle face 150A, a preliminary discharge is also carried out in order to prevent the foreign matter from becoming mixed inside the nozzles 151 by the wiper sliding operation.

On the other hand, if air bubbles become intermixed into a nozzle 151 or a pressure chamber 152, or if the rise in the viscosity of the ink inside a nozzle 151 exceeds a certain level, then it may not be possible to eject ink in the dummy ejection operation described above. In cases of this kind, the cap 164 forming a suction device is pressed against the nozzle surface 150A of the print head 150, and the ink inside the pressure chambers 152 (namely, the ink containing air bubbles of the ink of increased viscosity) is suctioned by a suction pump 167. The ink suctioned and removed by means of this suction operation is sent to a recovery tank 168. The ink collected in the recovery tank 168 may be used, or if reuse is not possible, it may be discarded.

Since the suctioning operation is performed with respect to all of the ink in the pressure chambers 152, it consumes a large amount of ink, and therefore, desirably, restoration by preliminary ejection is carried out while the increase in the viscosity of the ink is still minor. The suction operation is also carried out when ink is loaded into the print head 150 for the first time, and when the head starts to be used after being idle for a long period of time.

Description of Control System

Figure 16:
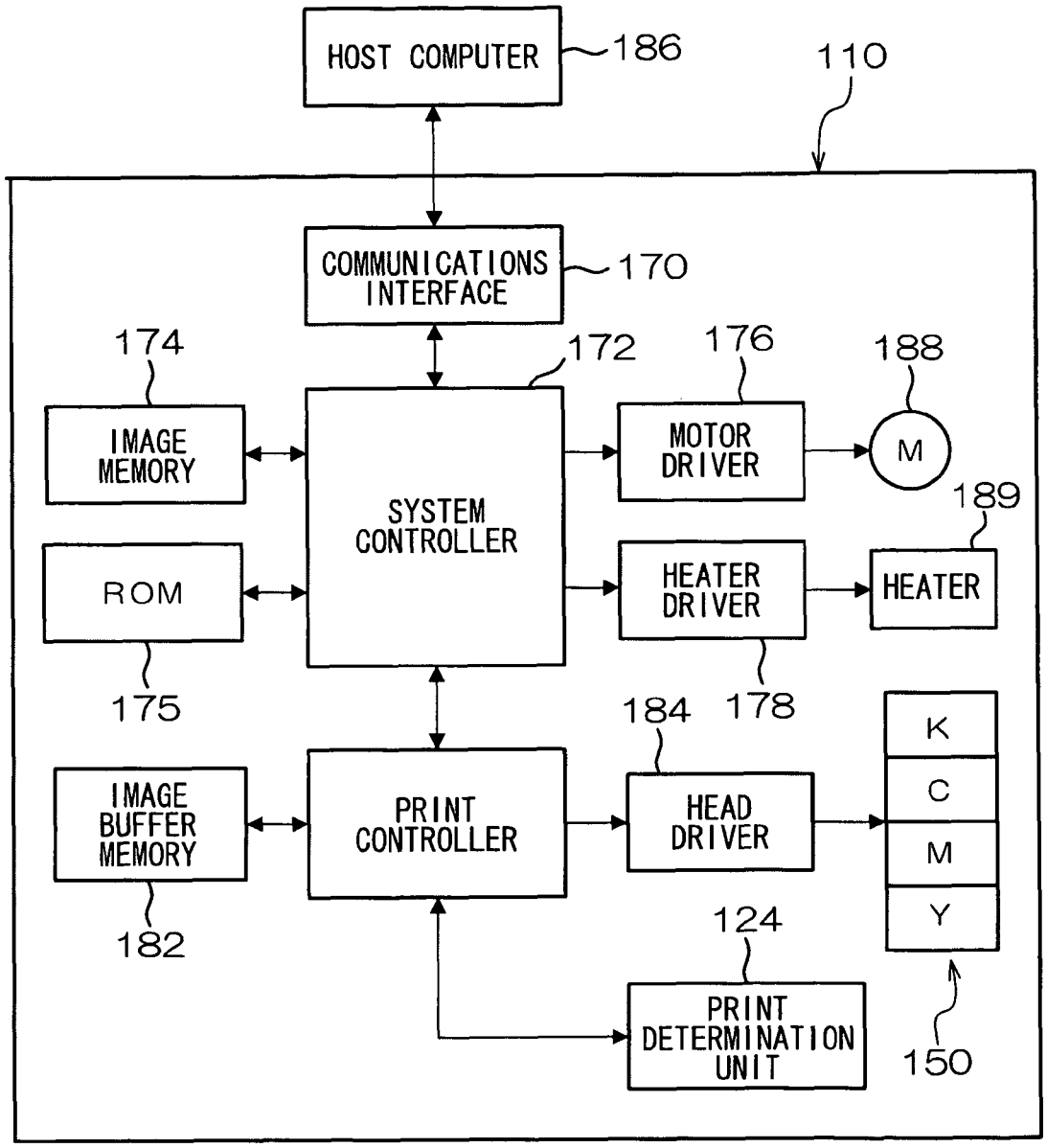
FIG. 16 is a principal block diagram illustrating the system configuration of the inkjet recording apparatus.

FIG. 16 is a block diagram illustrating a system composition of the inkjet recording apparatus 110. As illustrated in FIG. 16, the inkjet recording apparatus 110 comprises a communications interface 170, a system controller 172, an image memory 174, a ROM 175, a motor driver 176, a heater driver 178, a print controller 180, an image buffer memory 182, a head driver 184, and the like.

The communications interface 170 is an interface unit (image data input device) for receiving image data which is transmitted by a host computer 186. For the communications interface 170, a serial interface, such as USB (Universal Serial Bus), IEEE 1394, an Ethernet (registered tradename), or a wireless network, or the like, or a parallel interface, such as a Centronics interface, or the like, can be used. It is also possible to install a buffer memory (not illustrated) for achieving high-speed communications.

Image data sent from the host computer 186 is read into the image forming apparatus 110 via the communications interface 170, and is stored temporarily in the image memory 174. The image memory 174 is a storage device which stores an image input via the communications interface 170, and data is read from and written to the image memory 174 via the system controller 172. The image memory 174 is not limited to being a memory composed of a semiconductor element, and may also use a magnetic medium, such as a hard disk.

The system controller 172 is constituted by a central processing unit (CPU) and peripheral circuits thereof, and the like, and functions as a control apparatus which controls the whole of the inkjet recording apparatus 110 in accordance with prescribed programs, as well as functioning as a calculation apparatus which carries out various calculations. In other words, the system controller 172 controls the various units, such as the communications interface 170, the image memory 174, the motor driver 176, the heater driver 178, and the like, and controls communications with the host computer 186 as well as controlling the reading and writing of data to the image memory 174 and the ROM 175, and furthermore, it also generates control signals for controlling the motor 188 of the conveyance system and the heater 189.

The ROM 175 stores programs which are executed by the CPU of the system controller 172 and various data required for control purposes (including data of the ejection waveform for image formation and the ejection waveform for dummy ejection), and the like. The ROM 175 may be a non-rewritable storage device, or it may be a writable storage device, such as and EEPROM. The ROM 175 according to the present embodiment is constituted by a rewritable EEPROM and also serves as a history information storage device which stores operating history information for each of the heads of the respective heads, and ejection history information for each nozzle.

The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 of the post-drying unit 142 or the like in accordance with commands from the system controller 172.

The print controller 180 has a signal processing function for performing various tasks, compensations, and other types of processing for generating print control signals from the image data (original image data) stored in the image memory 174 in accordance with commands from the system controller 172 so as to supply the generated print data (dot data) to the head driver 184.

The print controller 180 according to the present embodiment generates drive control signals for the respective heads by combining the ejection waveform for image formation and the ejection waveform for dummy ejection which are stored in the ROM 175, and the image data for recording. For example, the data for dummy ejection is inserted in the blank portions between images in the image forming waveform data of the images that are to be recorded. Alternatively, dummy ejection data is inserted in a dispersed fashion within the image forming waveform data of an image that is to be recorded, according to a prescribed rule which avoids affecting the formed image.

The image buffer memory 182 is provided with the print controller 180, and image data, parameters, and other data are temporarily stored in the image buffer memory 182 when image data is processed in the print controller 180. FIG. 16 illustrates a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed is input from an external source via the communications interface 170, and is accumulated in the image memory 174. At this stage, RGB image data is stored in the image memory 174, for example.

In this inkjet recording apparatus 110, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the image memory 174 is sent to the print controller 180 through the system controller 172, and is converted to the dot data for each ink color by a half-toning technique, using a threshold value matrix, error diffusion, or the like, in the print controller 180.

In other words, the print controller 180 performs processing for converting the input RGB image data into dot data for the four colors of K, C, M and Y. The dot data generated by the print controller 180 in this way is stored in the image buffer memory 182.

The head driver 184 outputs drive signals for driving the actuators 158 corresponding to the nozzles 151 of the head 150, on the basis of print data (in other words, dot data stored in the image buffer memory 182) supplied by the print controller 180. A feedback control system for maintaining constant drive conditions in the head may be included in the head driver 184.

By supplying the drive signals output by the head driver 184 to the print heads 150, ink is ejected from the corresponding nozzles 151. By controlling ink ejection from the print head 150 in synchronization with the conveyance speed of the recording paper 116, an image is formed on the recording paper 116.

As described above, the ejection volume and the ejection timing of the ink droplets from the respective nozzles are controlled via the head driver 184, on the basis of the dot data generated by implementing required signal processing in the print controller 180. By this means, desired dot size and dot positions can be achieved.

The print determination unit 124 is a block that includes the image sensor as described above with reference to FIG. 10, reads the image printed on the recording paper 116, determines the print conditions (presence of the ejection, variation in the dot formation, optical density, and the like) by performing required signal processing, or the like, and provides the determination results of the print conditions to the print controller 180 and the system controller 172.

The print controller 180 implements various corrections with respect to the head 150, on the basis of the information obtained from the print determination unit 124, according to requirements, and it implements control for carrying out cleaning operations (nozzle restoring operations), such as preliminary ejection, suctioning, or wiping, as and when necessary.

For example, whenever an ejection defect is detected in the head 150 by the print determination unit 124, then the print controller 180 implements control in such a manner that preliminary ejection is carried out automatically. Alternatively, it is possible to adopt a mode in which, whenever an ejection defect of the head 150 has been determined by the print determination unit 124, control is implemented in such a manner that preliminary ejection is carried out automatically only in the head (112C, 112M, 112Y and 112K) where the ejection defect has been determined, or only in the nozzle row or the particular nozzle which is suffering an ejection defect in that head.

In the embodiment described above, the inkjet recording apparatus is based on a system which forms an image by ejecting ink droplets directly onto a recording medium, such as recording paper 116 (a direct recording method), but the scope of application of the present invention is not limited to this.

Second Example of Composition of Inkjet Recording Apparatus

Figure 17:
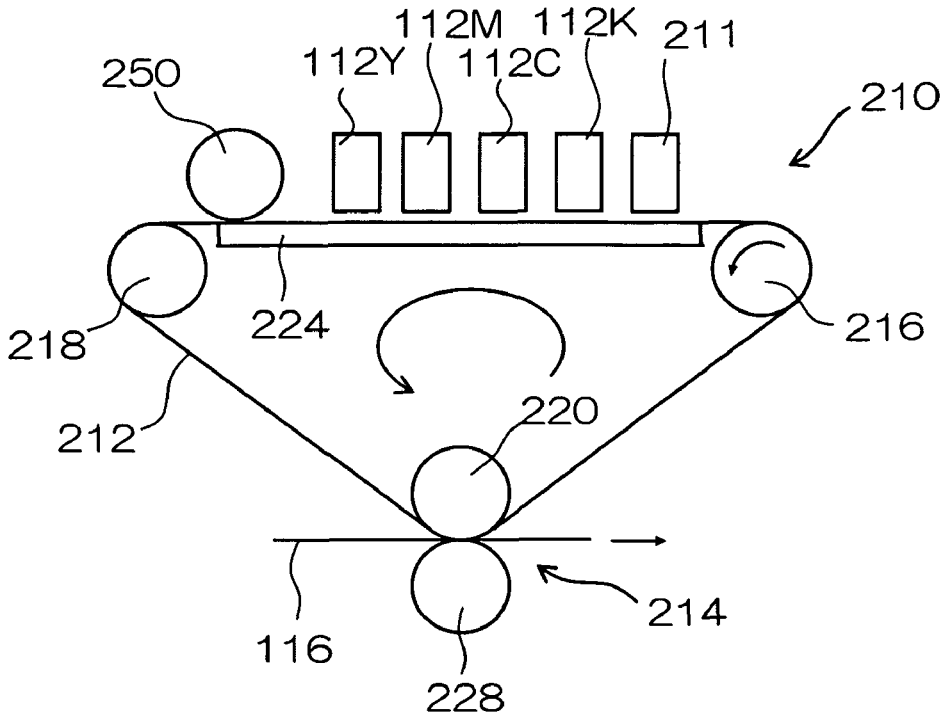
FIG. 17 is a principal schematic drawing illustrating an example of the composition of an inkjet recording apparatus of an intermediate transfer type.

FIG. 17 is a principal schematic drawing illustrating a further example of the composition of the inkjet recording apparatus. The mode of the inkjet recording apparatus 210 illustrated in FIG. 17 is an image forming apparatus in which, rather than forming an image directly onto a recording medium, an image (primary image) is formed temporarily on an intermediate transfer body 212 and this image is then transferred onto recording paper 116 in a transfer unit 214, thereby creating a final image. In FIG. 17, elements which are the same as or similar to those in FIG. 10 are labeled with the same reference numerals and further explanation thereof is omitted here.

In the inkjet recording apparatus 210 illustrated in FIG. 17, an endless belt member is used as the intermediate transfer body 212. The intermediate transfer body 212 is made of a non-permeable medium (for example, a polyimide film, urethane rubber, silicone rubber, or the like). It is also possible to make only the layer on the front surface side of the intermediate transfer body 212 (the side on which the ink is deposited), from a non-permeable medium.

In FIG. 17, the intermediate transfer body 212 is composed so as to be wound about the exterior of three rollers 216, 218 and 220. The first roller 216 is a drive roller to which the motive force of the drive motor (not illustrated) is transmitted, and the other rollers (the second roller 218 and the third roller 220) are idle rollers which rotate due to the movement of the intermediate transfer body 212. When the first roller 216 rotates due to the driving of the drive motor, the intermediate transfer body 212 turns in the counter-clockwise direction in FIG. 17 (hereinafter, called the "direction of rotation of the transfer body") due to this rotation.

A plurality of heads 112K, 112C, 112M and 112Y which correspond to the respective colors of black (K), cyan (C), magenta (M) and yellow (Y) are provided in sequence from the upstream side in the direction of rotation of the transfer body, at positions opposing the front surface (outer circumferential surface) of the intermediate transfer body 212, between the first roller 216 and the second roller 218. Furthermore, a treatment liquid ejection head 211 (which corresponds to the "treatment material ejection head") for ejecting treatment liquid for promoting the aggregation or curing of ink coloring material (this treatment liquid corresponds to a "liquid material" that reduces the fluidity of the ink) is disposed to the upstream side of this group of heads of the respective colors of ink.

The treatment liquid ejection head 211 is also a full line type of line head which has a similar composition to the ink heads 112K, 112C, 112M and 112Y, and is able to record an image over the whole surface of the intermediate transfer body 212 by carrying out just one operation of moving the intermediate transfer body 212 and the heads (112K, 112C, 112M, 112Y and 211) relatively with respect to each other in the direction of rotation of the transfer body, without moving the heads (112K, 112C, 112M, 112Y and 211) in the breadthways direction of the intermediate transfer body 212. Therefore, it is possible to improve the recording speed.

Droplets of treatment liquid are ejected while being controlled to a required volume, in accordance with the image contents that are to be recorded. It is also possible to deposit treatment liquid only onto the droplet ejection positions which are created by dummy ejection.

A platen 224 which forms a supporting member for the intermediate transfer body 212 is disposed at a position opposing the heads (112K, 112C, 112M, 112Y and 211) on the other side of the intermediate transfer body 212 from same. Droplets are ejected from the respective heads in a state where the surface of the intermediate transfer body 212 is maintained in a flat shape at least at the position opposing the respective heads (112K, 112C, 112M, 112Y and 211) by means of the platen 224.

A solvent removal roller 250 is disposed so as to make contact with the surface of the intermediate transfer body 212, on the downstream side of the yellow head 112Y in terms of the direction of rotation of the transfer body. The solvent removal roller 250 is a solvent removal device which removes excess solvent by making contact with the solvent of the ink that has been deposited on the intermediate transfer body 212. This solvent removal roller 250 is constituted by a porous member, for example, and absorbs and removes liquid from the intermediate transfer body 212.

The solvent removal roller 250 according to the present embodiment also serves as a suction device which removes liquid droplets that have been deposited on the intermediate transfer body 212 by dummy ejection. Rather than suctioning up solvent by capillary action using a porous member, it is also possible to employ a suctioning mechanism which suctions and removes the solvent by suction using a pump, or the like.

In the example illustrated in the drawing, one solvent removal roller 250 is provided on the furthest downstream side of the group of ink heads, but there is also a mode in which a solvent removal roller 250 is provided respectively on the downstream side of each of heads of the respective colors (112K, 112C, 112M and 112Y). This mode is especially suitable for cases where the amount of solvent of the ink deposited by the heads is high, since it enables the excess solvent to be recovered reliably.

The transfer unit 214 which transfers an image from the intermediate transfer body 212 to the recording paper 116 is disposed on the downstream side of the solvent removing roller 250 in terms of the direction of rotation of the transfer body. A nip roller 228 is provided in the transfer unit 214 at a position which opposes the third roller 220 via the intermediate transfer body 212, and a prescribed nip pressure is applied by the nip roller 228 to the rear surface side of the recording paper 116 (the opposite side to the recording surface).

In this way, an image (secondary image) is transferred to the recording paper 116 when the paper passes through the transfer unit 214, and the printed object thus generated (namely, recording paper 116 on which an image has been formed) is output from the print output unit (not illustrated).

As illustrated by the example in FIG. 17, it is also possible to apply the present invention to an inkjet recording apparatus of an intermediate transfer type.

Modification Example 1

In the embodiment illustrated in FIG. 17, a composition is described in which droplets of treatment liquid are ejected first and then droplets of ink are ejected subsequently, but the droplet ejection sequence of the treatment liquid and the ink is not limited to this example and it is also possible to adopt a mode in which droplets of ink ejected first and droplets of treatment liquid are ejected subsequently, or a mode in which treatment liquid and ink are deposited on the medium simultaneously, or the like.

Modification Example 2

In FIG. 17, only one treatment liquid ejection head 211 is disposed on the furthest upstream side of the group of ink heads, but it is also possible to adopt a composition in which treatment liquid ejection heads are disposed respectively on the upstream side (or the downstream side) of each of the heads 112K, 112M, 112C and 112Y of the respective colors. By means of this composition, it is possible to deposit a suitable amount of treatment liquid respectively and independently for each color of ink.

Modification Example 3

In FIG. 17, treatment liquid is deposited by an inkjet type of ejection head (211), but it is also possible to adopt a mode in which treatment liquid is deposited by an application device (not illustrated), which is typically an application roller, such as a gravure roller, instead of the ejection head.

Modification Example 4

It is also possible to adopt a mode in which a heating device and/or drying device (not illustrated) is provided instead of or in combination with the solvent removal roller 250 in FIG. 17.

For the heating device and the drying device, it is possible to employ an apparatus (device) which generates an infrared beam, microwaves or heated air, or a mode which brings a heated body into contact with the medium, or the like.

The heating device and drying device also serve as devices for drying the liquid droplets which are deposited onto the intermediate transfer body 212 by dummy ejection.

Third Example of Composition of Inkjet Recording Apparatus

Figure 18:
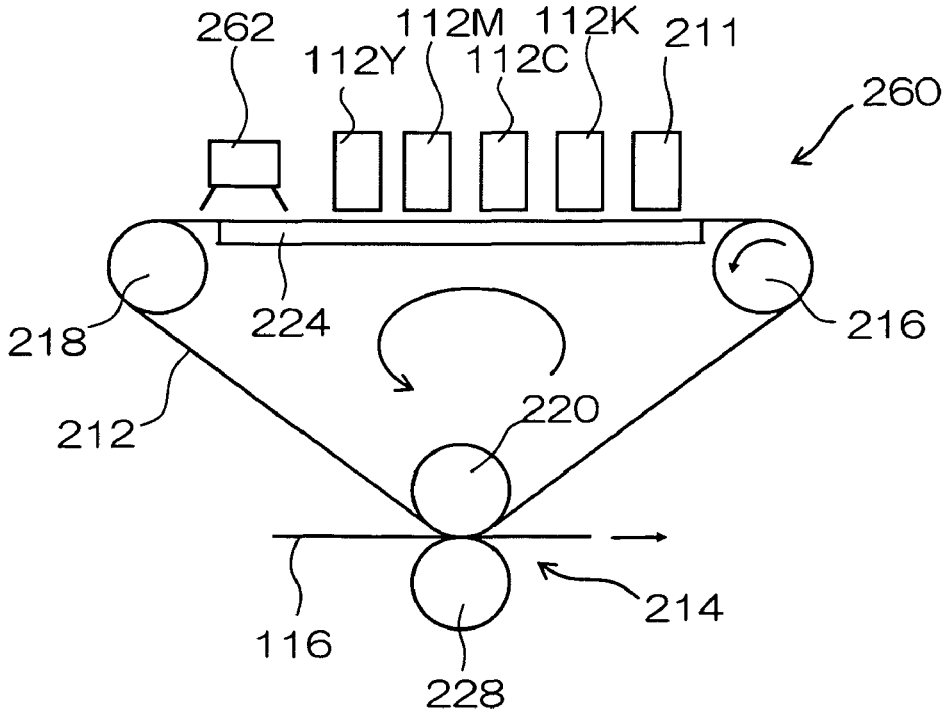
FIG. 18 is a principal schematic drawing illustrating a further example of the composition of an inkjet recording apparatus of an intermediate transfer type.

FIG. 18 is a principal schematic drawing illustrating a further example of the composition of the inkjet recording apparatus. In FIG. 18, elements which are the same as or similar to those in FIG. 17 are labeled with the same reference numerals and further explanation thereof is omitted here. The inkjet recording apparatus 260 illustrated in FIG. 18 is an inkjet recording apparatus of an intermediate transfer type which uses an ultraviolet-curable ink (so-called "UV ink").

This inkjet recording apparatus 260 uses an ultraviolet light source 262 which is disposed after the head group. This ultraviolet light source 262 functions as a device for curing the ink by irradiating ultraviolet light onto the ink which has been deposited on the intermediate transfer body 212.

A primary image is formed onto the intermediate transfer body 212 by means of the ink ejected from the respective heads 112K, 112M, 112C and 112Y becoming attached to the intermediate transfer body 212. With the movement of the intermediate transfer body 212, this primary image receives the irradiation of ultraviolet light from the ultraviolet light source 262.

The ink on the intermediate transfer body 212 is polymerized and cured by ultraviolet light and is fixed onto the intermediate transfer body 212 in a cured ink state.

The amount of ultraviolet light irradiated (the energy density and the irradiation time) are controlled so as to apply the energy required in order to cure the ink.

The ultraviolet source 262 has a structure in which, for example, a plurality of ultraviolet LED elements are arranged in a line configuration following the breadthways direction of the intermediate transfer body 212, cylindrical condensing lenses or a micro lens array being disposed below this row of ultraviolet LED elements. It is also possible to employ a composition using LD (laser diode) elements instead of LEDs.

The light emitted from the group of ultraviolet LED elements is condensed into a line shape following a direction that is substantially perpendicular to the paper feed direction by the action of the cylindrical lenses, and is irradiated onto the intermediate transfer body 212. Instead of the cylindrical lenses, it is also possible to use a group of lenses having one or more aspherical surface having an optically refractive shape and a condensing power which is similar to that of the cylindrical lenses.

By selectively emitting light from the group of ultraviolet LED elements and controlling the amount of light emitted from the respective elements, it is possible to achieve a desired irradiation range and light amount (intensity) distribution in the irradiation area of the ultraviolet light.

By suitably controlling the light emission positions and the light emission amounts of the ultraviolet LED elements in accordance with the range of ink droplet ejection and the ink volume so as to emit the minimum necessary amount of light, then adverse effects to the head (the curing of ink inside the nozzles, and the like) are restricted to a minimum.

The ultraviolet light source 262 according to the present embodiment also serves as an energy beam irradiation device which cures liquid droplets that have been deposited on the intermediate transfer body 212 by dummy ejection.

Modification Example 5

The energy beam also includes visible light, ultraviolet light, electromagnetic waves including X rays, an electron beam, and the like, and apart from the ultraviolet-curable ink described above, another typical example of the energy beam-curable ink is an electron beam-curable ink (a so-called "EB ink").

When an EB ink is used, an electron beam irradiation apparatus (not illustrated) is disposed instead of the ultraviolet light source 262. In other words, the concrete composition of the energy beam irradiation device is selected in accordance with the type of ink used.

Modification Example 6

It is also possible to adopt a mode which uses a drum-shaped intermediate transfer body (intermediate transfer drum) instead of the intermediate transfer body 212 comprising an endless belt illustrated in FIG. 17 and FIG. 18.

Modification Example 7

In the respective embodiments described above, an inkjet recording apparatus using a page-wide full line type head having a nozzle row of a length corresponding to the entire width of the recording medium is described, but the scope of application of the present invention is not limited to this, and the present invention may also be applied to an inkjet recording apparatus which performs image recording by means of a plurality of head scanning actions which move a short recording head, such as a serial head (shuttle scanning head), or the like.

Furthermore, the meaning of the term "image forming apparatus" is not restricted to a so-called graphic printing application for printing photographic prints or posters, but rather also encompasses industrial apparatuses which are able to form patterns that may be perceived as images, such as resist printing apparatuses, wire printing apparatuses for electronic circuit substrates, ultra-fine structure forming apparatuses, or the like.

APPENDIX

As has become evident from the detailed description of the embodiments of the present invention given above, the present specification includes disclosure of various technical ideas including the invention described below.

One aspect of the invention is directed to a method of manufacturing at least one projecting section of a nozzle plate used in a liquid ejection head, the method comprising: a partial lyophilic rendering step of rendering a lyophilic characteristic to a portion of a lyophobic film provided on an ejection surface side of a substrate in which a nozzle is formed, so as to form a lyophobic portion and a lyophilic portion on the ejection surface side of the substrate; a resin deposition step of depositing a curable resin on the lyophilic portion which has been rendered the lyophilic characteristic; and a curing step of curing the resin deposited on the lyophilic portion in such a manner that the cured resin forms the projecting section.

According to this aspect of the invention, the adhesiveness of a resin is improved by rendering a lyophobic film lyophilic in a localized fashion. Furthermore, since it is possible to apply the resin onto the lyophilic portion only, then the patterning of the resin is simplified. Moreover, the resin deposited onto the lyophilic portion is subsequently cured and thereby a projecting section is formed by the cured resin; therefore it is possible to form a projecting section (a step section) simply and inexpensively in comparison with a method in which a separate plate member is attached as in the related art. Furthermore, restoration can also be carried out easily in the event of damage to the projecting section.

Desirably, in the partial lyophilic rendering step, the lyophilic characteristic is rendered to the portion of the lyophobic film by removing or modifying the portion of the lyophobic film.

In the case of a mode where a portion of the lyophobic film is modified, a lyophobic film (modified film) will exist between the substrate and the resin, whereas in a case where a portion of the lyophobic film is removed, the resin is applied directly to the substrate, and therefore the adhesiveness is excellent.

Desirably, in the partial lyophilic rendering step, a lyophobic-film-forming section where the lyophobic film is formed and a non-lyophobic-film-forming section where the lyophobic film is not formed are patterned during formation of the lyophobic film, the non-lyophobic-film-forming section serving as the lyophilic portion.

By forming a lyophobic film selectively on the substrate, it is possible to create a lyophobic portion and a lyophilic portion simultaneously when forming the lyophobic film.

Desirably, the curable resin is a photo-curable resin.

Since the photo-curable resin can be cured without applying heat, then this is beneficial in avoiding warping of the head or damage caused by heat.

Desirably, in the resin deposition step, the curable resin is deposited on the lyophilic portion by a dispenser or an inkjet method.

According to this mode, it is possible to deposit resin only onto the portion where it is required, and therefore the resin does not enter into the nozzle and resin can be applied to the portion which has been rendered lyophilic only.

Desirably, in the resin deposition step, the curable resin is deposited in a continuous line shape, and in the curing step, the resin is cured so as to form the projecting section having a continuous line shape.

According to this mode, the resin can be applied simply.

Desirably, in the resin deposition step, the curable resin is deposited in a broken line shape, and in the curing step, the resin is cured so as to form the projecting section having a broken line shape.

According to this mode, it is simple to manufacture the corresponding mask to process one surface simultaneously, and even in the case of a recording process using a dispenser, or the like, it is possible to avoid mounding up of the resin due to overlapped recording. Furthermore, by means of the broken line-shaped projecting sections, the properties of removing liquid during wiping are improved.

Desirably, a lyophobic film is formed on the resin after the curing step.

The liquid removal properties are further improved by forming a lyophobic film also on the surface of the projecting section made of resin.

Another aspect of the invention is directed to a nozzle plate comprising a substrate including a nozzle, and at least one projecting section that is made on a periphery of the nozzle by any one of the above-described methods of manufacturing at least one projecting section of a nozzle plate.

According to this aspect of the present invention, it is possible to protect a nozzle by means of the projecting section on the periphery of the nozzle, as well as obtaining a merit in reducing the liability of damage to the wiping blade.

Desirably, the projecting section has a broken line shape.

According to this mode, the liquid removal properties during wiping are good.

Desirably, the projecting section is formed in an oblique direction with respect to a wiping direction of the nozzle plate.

According to this mode, little damage is caused to the blade during wiping.

One compositional example of a liquid ejection head according to an embodiment of the present invention is a full line type head in which a plurality of nozzles are arranged through a length corresponding to the full width of the ejection receiving medium. In this case, a mode may be adopted in which a plurality of relatively short recording head modules having nozzle rows which do not reach a length corresponding to the full width of the ejection receiving medium are combined and joined together, thereby forming nozzle rows of a length that correspond to the full width of the ejection receiving medium.

A full line type head is usually disposed in a direction that is perpendicular to the feed direction (conveyance direction) of the ejection receiving medium, but a mode may also be adopted in which the head is disposed following an oblique direction that forms a prescribed angle with respect to the direction perpendicular to the conveyance direction.

The conveyance device for causing the ejection receiving medium and the liquid ejection head to move relative to each other may include a mode where the ejection receiving medium is conveyed with respect to a stationary (fixed) head, or a mode where a head is moved with respect to a stationary ejection receiving medium, or a mode where both the head and the ejection receiving medium are moved.

The "ejection receiving medium" is a medium which receives the deposition of liquid droplets ejected from a nozzle(s) (an ejection port(s)) of a liquid ejection head, and this term includes a print medium, image forming medium, recording medium, image receiving medium, ejection receiving medium, intermediate transfer body, and a conveyance device such as a conveyance belt of a recording medium, and the like, in an inkjet printer. There are no particular restrictions on the shape or material of the medium, which may be various types of media, irrespective of material and size, such as continuous paper, cut paper, sealed paper, resin sheets such as OHP sheets, film, cloth, a printed circuit substrate on which a wiring pattern, or the like, is formed, a rubber sheet, a metal sheet, or the like.

Another aspect of the present invention is directed to an inkjet head comprising any one of the nozzle plates described above.

According to this aspect of the present invention, it is possible to achieve a head which is highly durable in respect of paper jamming or wiping.

Another aspect of the present invention is directed to an image forming apparatus comprising any one of the inkjet heads described above.

When forming color images by using an inkjet head, it is possible to provide a recording head for each color of a plurality of colored inks (recording liquids), or it is possible to eject inks of a plurality of colors, from one print head.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of manufacturing at least one projecting section of a nozzle plate used in a liquid ejection head, the method comprising:

a partial lyophilic rendering step of rendering a lyophilic characteristic to a portion of a lyophobic film provided on an ejection surface side of a substrate in which a nozzle is formed, so as to form a lyophobic portion and a lyophilic portion on the ejection surface side of the substrate;

a resin deposition step of depositing a curable resin on the lyophilic portion which has been rendered the lyophilic characteristic; and a curing step of curing the resin deposited on the lyophilic portion in such a manner that the cured resin forms the projecting section.

2. The method of manufacturing at least one projecting section of a nozzle plate as defined in claim 1, wherein in the partial lyophilic rendering step, the lyophilic characteristic is rendered to the portion of the lyophobic film by removing or modifying the portion of the lyophobic film.

3. The method of manufacturing at least one projecting section of a nozzle plate as defined in claim 1, wherein in the partial lyophilic rendering step, a lyophobic-film-forming section where the lyophobic film is formed and a non-lyophobic-film-forming section where the lyophobic film is not formed are patterned during, formation of the lyophobic film, the non-lyophobic-film-forming section serving as the lyophilic portion.

4. The method of manufacturing at least one projecting section of a nozzle plate as defined in claim 1, wherein the curable resin is a photo-curable resin.

5. The method of manufacturing at least one projecting section of a nozzle plate as defined in claim 1, wherein in the resin deposition step, the curable resin is deposited on the lyophilic portion by a dispenser or an inkjet method.

6. The method of manufacturing at least one projecting section of a nozzle plate as defined in claim 1, wherein in the resin deposition step, the curable resin is deposited in a continuous line shape, and in the curing step, the resin is cured so as to form the projecting section having a continuous line shape.

7. The method of manufacturing at least one projecting section of a nozzle plate as defined in claim 1, wherein in the resin step, the curable resin is deposited in a broken line shape, and in the curing step, the resin is cured so as to form the projecting section having a broken line shape.

8. The method of manufacturing at least one projecting section of a nozzle plate as defined in claim 1, wherein a lyophobic film is formed on the resin after the curing step.

* * * * *